US006736114B2

(12) United States Patent
Takahashi et al.

(10) Patent No.: US 6,736,114 B2
(45) Date of Patent: May 18, 2004

(54) CONTROL SYSTEM AND CONTROL METHOD FOR IN-CYLINDER INJECTION TYPE INTERNAL COMBUSTION ENGINE

(75) Inventors: Jun Takahashi, Toyota (JP); Kazuhiro Iwahashi, Okazaki (JP); Kiyoo Hirose, Nagoya (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 26 days.

(21) Appl. No.: 10/237,096

(22) Filed: Sep. 9, 2002

(65) Prior Publication Data

US 2003/0056764 A1 Mar. 27, 2003

(30) Foreign Application Priority Data

Sep. 26, 2001 (JP) ..... 2001-292927

(51) Int. Cl.[7] ..... F02M 51/00
(52) U.S. Cl. ..... 123/491; 123/478
(58) Field of Search ..... 123/491, 478, 123/472, 443

(56) References Cited

U.S. PATENT DOCUMENTS 5,394,857 A * 3/1995 Yamakawa ..... 123/686

FOREIGN PATENT DOCUMENTS

JP A 11-270386 10/1999

* cited by examiner

*Primary Examiner*—Bibhu Mohanty
(74) *Attorney, Agent, or Firm*—Oliff & Berridge, PLC

(57) ABSTRACT

It is highly likely that fuel is already adhered to the inside wall surface of the combustion chamber at the beginning of engine startup when it is estimated that the temperature at the beginning of engine stop of the most recent engine operation is low when the engine is restarted. Under these conditions, a fuel injection quantity is reduced or an intake air quantity is increased when the engine is restarted. Therefore, even if the adhered fuel vaporizes when the engine is restarted, the air-fuel ratio will not become excessively rich as a result.

25 Claims, 16 Drawing Sheets

CONTROL SYSTEM AND CONTROL METHOD FOR IN-CYLINDER INJECTION TYPE INTERNAL COMBUSTION ENGINE

INCORPORATION BY REFERENCE

The disclosure of Japanese Patent Application No. 2001-292927 filed on Sep. 26, 2001 including the specification drawings, and abstract is incorporated herein by reference in its entirety.

BACKGROUND OF THE INVENTION

1. Field of the Invention

The invention relates to a control system and a control method for an in-cylinder injection type internal combustion engine.

2. Description of Related Art

In an in-cylinder injection type internal combustion engine used in an automobile, a large quantity of fuel is injected at the time of engine startup, due to the fact that some of the fuel that is injected adheres to the inside wall surface of the combustion chamber, the demanded fuel injection quantity is increased by a corresponding amount.

Thereafter, when the fuel adhered to the inside wall surface of the combustion chamber begins to vaporize, the demanded fuel injection quantity that has been increased at engine startup by the amount of fuel that vaporizes is decreased. Because the vaporization rate of the adhered fuel increases as the temperature of the combustion chamber rises, the fuel injection quantity can be reduced such that the fuel injection quantity decreases the higher the temperature of the combustion chamber, as is disclosed in Japanese Patent Application Laid-Open Publication No. 11-270386, for example.

When the engine is stopped when the temperature of the combustion chamber is still low after beginning to start the engine from a cold state, and then restarted immediately thereafter, a large amount of fuel, as described above, is injected because the temperature of the combustion chamber is low. This means that a large amount of fuel is injected even though the fuel injected when the engine was started the last time is adhered to the inside wall surface of the combustion chamber. As a result, the air-fuel ratio of the mixture in the combustion chamber may become rich thus leading to poor combustion of the mixture.

SUMMARY OF THE INVENTION

In view of the foregoing problem, it is an object of the invention to provide a control system or a control method for an in-cylinder injection type internal combustion engine that can prevent the air-fuel ratio of the mixture in the combustion chamber from becoming excessively rich when the engine is restarted when the temperature of the combustion chamber at the beginning of engine stop of the most recent engine operation is low, and therefore minimize the possibility of poor combustion of that mixture resulting from an excessively rich air-fuel mixture.

In order to achieve the foregoing object, according to a first aspect of the invention, a control system for an in-cylinder injection type internal combustion engine is provided with a controller that estimates the temperature of a combustion chamber at the beginning of engine stop of the most recent engine operation when there is a command to start the engine, and that corrects the air-fuel ratio of the mixture supplied to the combustion chamber at engine startup to the lean side based on the estimated temperature of the combustion chamber.

When the temperature of the combustion chamber is low at the beginning of engine stop of the most recent engine operation, it is highly likely that fuel is already adhered to the inside wall surface of the combustion chamber when the engine is restarted. According to this first aspect of the invention, it is possible to mitigate the air-fuel ratio of the mixture within the combustion chamber from becoming excessively rich, and therefore minimize the possibility of poor combustion of that mixture resulting from an excessively rich air-fuel mixture under these conditions by correcting the air-fuel ratio of the mixture to the lean side.

Moreover, the controller may also correct the air-fuel ratio to the lean side by reducing the fuel injection quantity at engine startup based on the estimated temperature of the combustion chamber. In particular, because it is highly likely that fuel is already adhered to the inside wall surface of the combustion chamber when the engine is restarted when the estimated temperature of the combustion chamber is low, reducing the fuel injection quantity at engine startup can prevent the air-fuel ratio of the mixture inside the combustion chamber from becoming excessively rich, and therefore minimize the possibility of poor combustion of that mixture resulting from an excessively rich air-fuel mixture.

Further, the controller may also reduce the fuel injection quantity at engine startup when the amount of time from the most recent engine operation until engine startup is short.

For a short interval between the most recent engine operation and the engine restart is short, the fuel adhered to the inside wall surface of the combustion chamber has insufficient time to completely vaporized. As a result, it is highly likely that fuel is already adhered to the inside wall surface of the combustion chamber when the engine is restarted. By reducing the fuel injection quantity at engine startup when only a short amount of time has passed after the most recent engine operation, it is possible to minimize the possibility of the fuel injection quantity being reduced unnecessarily.

Moreover, the air-fuel ratio may also be corrected to the lean side by increasing the intake air quantity based on the estimated temperature of the combustion chamber. In particular, because it is highly likely that fuel is already adhered to the inside wall surface of the combustion chamber upon engine restart when the estimated temperature of the combustion chamber is low, increasing the intake air quantity at engine startup can avoid excessively rich air-fuel ratio of the mixture inside the combustion chamber, and therefore minimize the possibility of poor combustion of that mixture resulting from an excessively rich air-fuel mixture.

Further, the controller may also increase the intake air quantity at engine startup when the amount of time from the most recent engine operation until engine startup is short.

For a short interval between the most recent engine operation and the engine restart, the fuel adhered to the inside wall surface of the combustion chamber is not able to be completely vaporized during that time. As a result, it is highly likely that fuel is already adhered to the inside wall surface of the combustion chamber when the engine is restarted. By increasing the intake air quantity at engine startup when only a short amount of time has passed after the most recent engine operation, it is possible to minimize the possibility of the fuel injection quantity being reduced unnecessarily.

Also, the temperature of the combustion chamber at the beginning of engine stop may also be estimated based on at least the engine cooling water temperature at the beginning of engine stop of the most recent engine operation.

When the cooling water temperature is low at the beginning of engine stop, the temperature of the combustion chamber is also low at the beginning of engine stop. Therefore, by estimating the temperature of the combustion chamber based on the engine cooling water temperature when the engine was stopped the last time, it is possible to accurately estimate the temperature of the combustion chamber at the beginning of engine stop.

Also, according to a control method for an in-cylinder injection type internal combustion engine, in a second aspect of the invention, the temperature of the combustion chamber at the beginning of engine startup of the most recent engine operation is estimated when there is a command to start the engine. The air-fuel ratio of the mixture to be supplied to the combustion chamber at engine startup is corrected to the lean side based on the estimated temperature of the combustion chamber.

When the temperature of the combustion chamber is low at the beginning of engine stop of the most recent engine operation, it is highly likely that fuel is already adhered to the inside wall surface of the combustion chamber when the engine is restarted. According to this second aspect of the invention, it is possible to mitigate the air-fuel ratio of mixture within the combustion chamber from becoming excessively rich, and thereby minimize the possibility of poor combustion of that mixture resulting from an excessively rich air-fuel mixture under these conditions by correcting the air-fuel ratio of the mixture to the lean side.

BRIEF DESCRIPTION OF THE DRAWINGS

The foregoing and further objects, features and advantages of the invention will become apparent from the following description of preferred exemplary embodiments with reference to the accompanying drawings, wherein like numerals are used to represent like elements and wherein.

DETAILED DESCRIPTION OF PREFERRED EMBODIMENTS

Hereinafter, a first exemplary embodiment in which the invention has been applied to an in-cylinder spark ignition type engine for an automobile will be described with reference to FIGS. 1 through 7.

Figure 1:
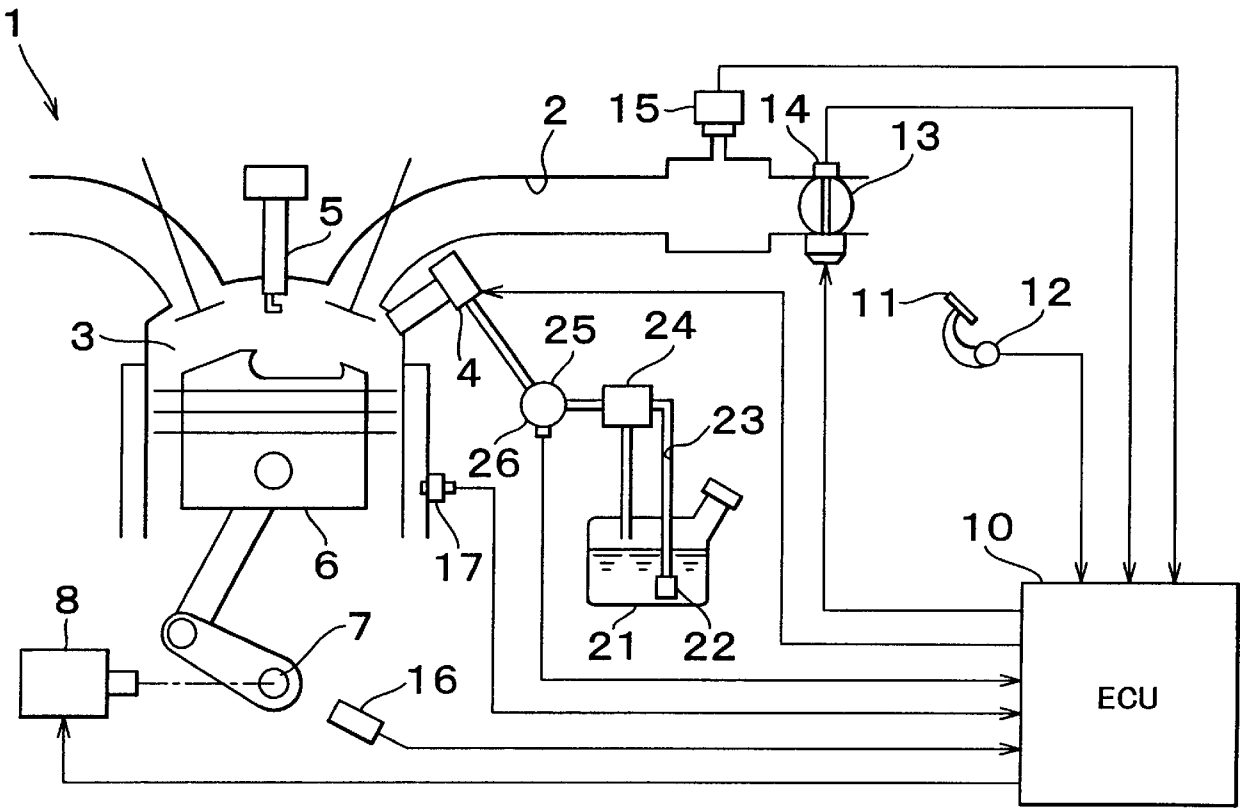
FIG. 1 is a schematic view showing an entire engine to which the fuel injection control system according to a first exemplary embodiment is applied.

In an engine 1 shown in FIG. 1, a mixture of air taken in through an intake duct 2 into a combustion chamber 3 and a fuel injected into the combustion chamber 3 is ignited by a spark plug 5. As the mixture burns, it generates energy which moves the piston 6 in a reciprocating manner that in turn rotates a crankshaft 7. Also, when the engine 1 is started up, a starter 8 is driven so as to forcibly rotate (cranking) the crankshaft 7.

A throttle valve 13 which is operated opened and closed so as to adjust a quantity of air (intake air quantity) taken into the combustion chamber 3 is provided at an upstream portion in the intake duct 2. The opening (throttle opening) of this throttle valve 13 is adjusted according to a depression amount (accelerator depression amount) of an accelerator pedal 11 which is depressed by a driver of a vehicle.

Further, fuel for the engine 1, which is stored in a fuel tank 21, is sent through a fuel supply line 23 by a low pressure fuel pump 22 to a high pressure fuel pump 24, by which it is pressurized and then supplied to a fuel injection valve 4 by a delivery pipe 25. The fuel is then injected from the fuel injection valve 4 into the combustion chamber 3.

An electronic control unit 10 for performing various driving control of the engine 1 is mounted in the vehicle. This electronic control unit 10 controls the fuel injection valve 4, the starter 8, and the throttle valve 13 so as to control the fuel injection quantity, startup, and throttle opening and the like of the engine 1. Moreover, the electronic control unit 10 receives detection signals from various sensors such as: an accelerator position sensor 12 for detecting the accelerator depression amount, a throttle position sensor 14 for detecting the position of the throttle (i.e., throttle opening), a vacuum sensor 15 for detecting the pressure on a downstream side of the throttle valve 13 in the intake duct 2, a crankshaft position sensor 16 for transmitting a signal indicative of the position of the rotating crankshaft 7, a water temperature sensor 17 for detecting the cooling water temperature of the engine 1, and a fuel pressure sensor 26 for detecting the pressure (fuel pressure) of the fuel within the delivery pipe 25.

Further, the electronic control unit 10 is provided with RAM (random access memory), which serves as memory for temporarily storing data and the like input from the various sensors, and backup RAM, which serves as non-volatile memory for storing data and the like to be stored when the engine 1 is stopped, and the like.

In the in-cylinder injection type engine 1 in which fuel is directly injected into the combustion chamber 3, the fuel injected from the fuel injection valve 4 when the engine is started up from a cold state tends to adhere to an inside wall surface of the combustion chamber 3. Therefore, when the engine is started up from a cold state, the demanded fuel injection quantity is increased by the amount of injected fuel that adheres to the inside wall surface of the combustion chamber 3. A large quantity of fuel is therefore injected by the fuel injection quantity control so that that demand is met.

However, when the engine 1 is stopped while the temperature of the combustion chamber 3 is still low after beginning to be started up from a cold state, and then restarted immediately thereafter, a large quantity of fuel is injected into the combustion chamber 3 despite the fact that the fuel injected when the engine was started up the last time adheres to the inside wall surface of the combustion chamber 3. As a result of this kind of fuel injection, the air-fuel ratio of the mixture within the combustion chamber becomes excessively rich, which leads to poor combustion of the mixture.

According to this exemplary embodiment, the temperature of the combustion chamber 3 at the beginning of engine stop of the most recent engine operation is estimated. When this temperature is determined to be low, the fuel injection quantity is reduced during startup of the engine 1, which includes while the engine 1 is in the process of being started up as well as a predetermined period of time after it has finished starting up. This is done in order to prevent the air-fuel ratio from becoming excessively rich when the engine is restarted because when the temperature of the combustion chamber 3 is low at the beginning of engine stop of the most recent engine operation, it is highly likely that fuel is already adhered to the inside surface wall of the combustion chamber 3 when the engine is restarted. That is, by reducing the fuel injection quantity as described above, even if the fuel that adhering to the inside wall surface of the combustion chamber 3 vaporizes when the engine is restarted, the air-fuel ratio avoids becoming excessively rich such that poor combustion of the mixture as a result can be minimized.

Next, a calculation routine of a water temperature Tstart at the beginning of engine startup and a water temperature Tstop at the beginning of engine stop used to estimate the temperature of the combustion chamber 3 at the beginning of engine stop will be described with reference to the flowchart in FIG. 2, which shows a start and stop process routine. This start and stop process routine is executed by the electronic control unit 10 at predetermined intervals of time, for example.

Figure 2:
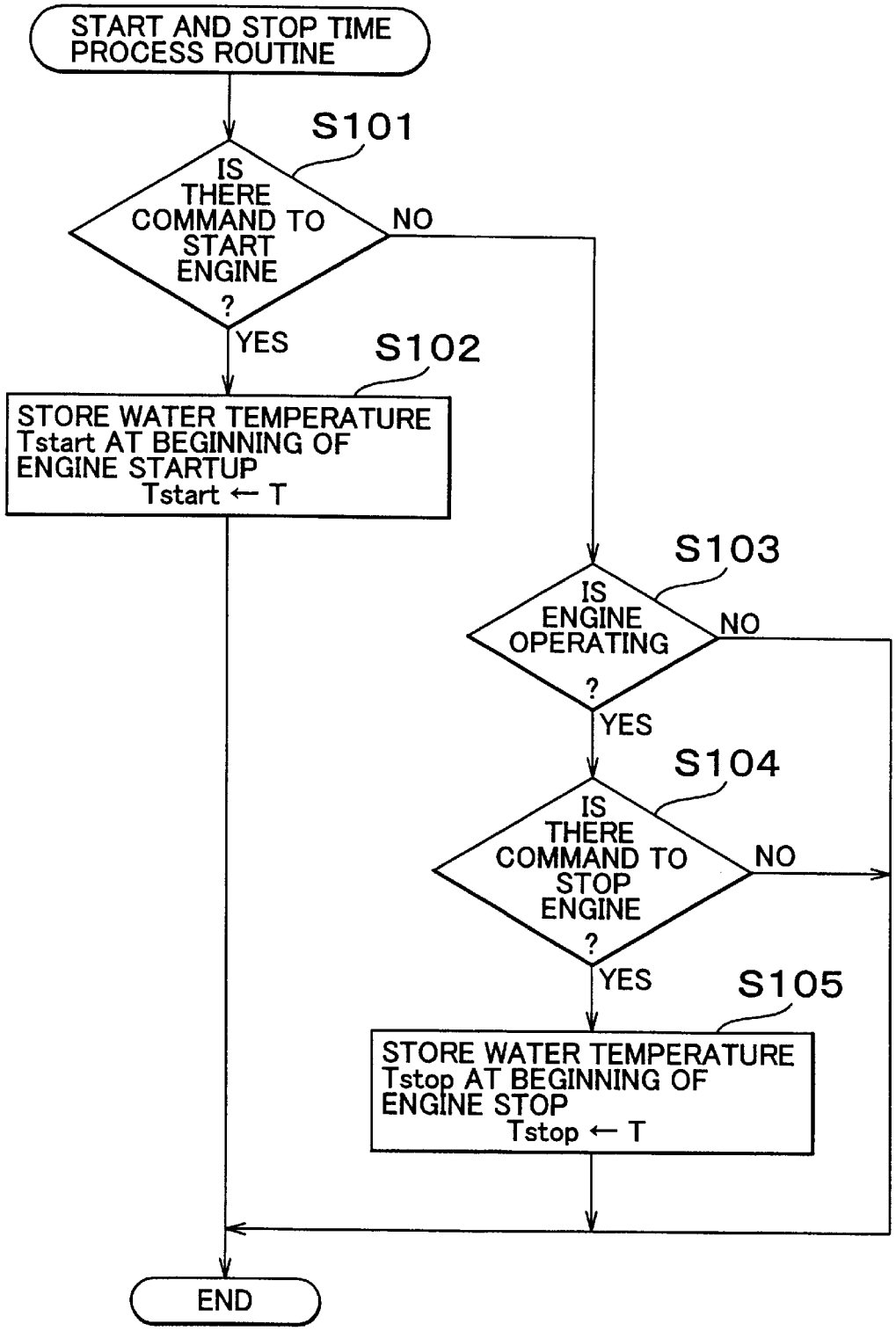
FIG. 2 is a flowchart showing a calculation routine of a water temperature Tstart at the beginning of engine startup and a water temperature Tstop at the beginning of engine stop.

In the start and stop process routine shown in FIG. 2, when there is a command to start the engine 1 (S101: YES), a cooling warning temperature T of the engine 1 at that time is stored as water temperature Tstart at the beginning of engine startup at a predetermined location in the backup RAM (S102). The cooling warning temperature T is obtained based on a detection signal from the water temperature sensor 17. Also, during operation of the engine (S103: YES), when there is a command to stop the engine 1 (S104: YES), the cooling warning temperature T of the engine 1 at that time is stored as water temperature Tstop at the beginning of engine stop at a predetermined location in the backup RAM (S105).

In this way, the memory of the water temperature Tstart at the beginning of engine startup and the water temperature Tstop at the beginning of engine stop is stored every time the engine 1 starts to be operated and every time the engine 1 starts to be stopped.

Figure 3A:
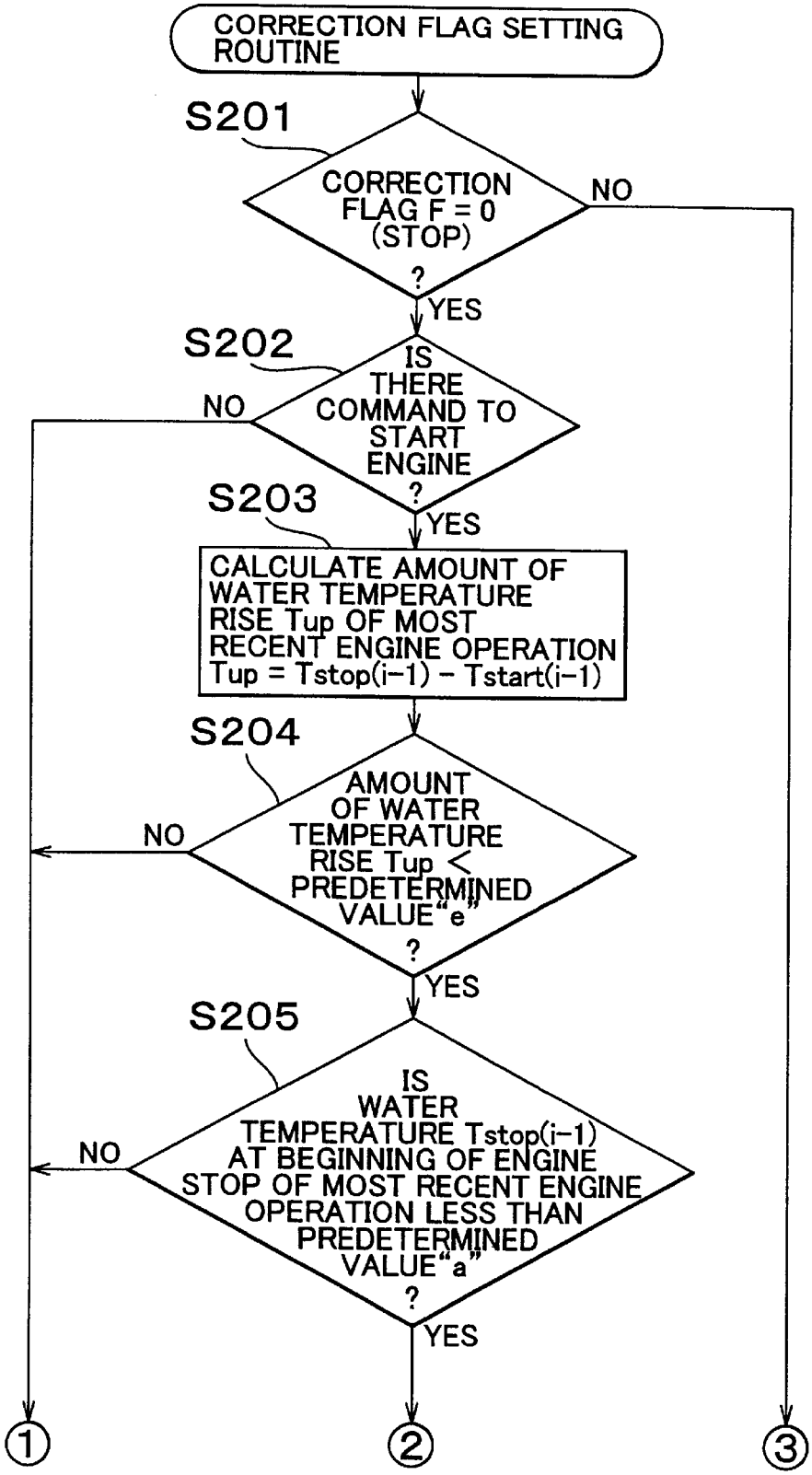
FIG. 3A and FIG. 3B are a flowchart showing a setting routine for a correction flag F according to the first exemplary embodiment.

Next, a setting routine of a correction flag F used for determining whether the fuel injection quantity should be reduced will be described with reference to the flowchart in FIG. 3A and FIG. 3B, which shows a correction flag setting routine. This correction flag setting routine is executed by the electronic control unit 10 at predetermined intervals of time, for example.

In the correction flag setting routine, when the correction flag F is "0 (stop)" (S201: YES), it is determined whether there has been a command to start the engine 1 (S202). When the determination in Step S202 is YES, [1] processes (S203 through S205) are performed for determining whether the temperature of the combustion chamber 3 is low at the beginning of engine stop of the most recent engine operation, and [2] processes (S206 and S207) are performed to determine whether the time from the most recent engine operation until the current engine start (engine stop time) is short.

Then, when the temperature of the combustion chamber 3 at the beginning of engine stop of the most recent engine operation is determined to be low and the time from the most recent engine operation until the current engine start is short in the processes of [1] and [2] above, the correction flag F is set to "1 (implement)" to reduce the fuel injection quantity (S208). This is done to minimize the possibility of the air-fuel ratio becoming rich when the engine is restarted by reducing the fuel injection quantity according to the following reasons.

(1) When the temperature of the combustion chamber 3 is low at the beginning of engine stop of the most recent engine operation, the engine 1 is stopped without the fuel that adhered to the inside wall surface of the combustion chamber 3 the last time the engine was started being completely vaporized while the engine was operating. As a result, it is highly likely that fuel is already adhered to the inside wall surface of the combustion chamber 3 when the engine is restarted. That adhered fuel will then vaporize, making the air-fuel ratio rich when the engine is restarted.

(2) When the time from the most recent engine operation until the current engine start is determined to be short, the engine 1 is restarted without the fuel that had adhered to the inside wall surface of the combustion chamber 3 at the beginning of the most recent engine stop being completely vaporized while the engine was stopped. As a result, it is highly likely that fuel is already adhered to the inside wall surface of the combustion chamber 3 when the engine is restarted. That adhered fuel will then vaporize, making the air-fuel ratio rich when the engine is restarted.

Also, the correction flag F that was set to "1", as described above, is reset to "0 (stop)" when a predetermined period of time has passed after there was a command to start the engine 1 (S209: YES) (S210). When the correction flag F is set to "0", the fuel injection quantity will not be reduced when the engine is started up.

Now each of the processes of [1] and [2] will be described in detail.

The processes of [1] are processes (S203 through S205) for determining whether the temperature of the combustion chamber 3 is low at the beginning of engine stop of the most recent engine operation.

In these processes, first an amount of water temperature rise Tup, which is an amount that the cooling warning temperature T rises from the most recent engine operation, is calculated by subtracting the water temperature Tstart (i−1) at the beginning of engine startup of the most recent engine operation from the water temperature Tstop (i−1) at the beginning of engine stop of the most recent engine operation (S203). Then the temperature of the combustion chamber 3 is determined to be low at the beginning of engine stop of the most recent engine operation based on the following two determinations:

(3) whether the amount of water temperature rise Tup is less than a predetermined value "e", that is, whether the amount of heat generated by the engine 1 during the most recent engine operation is enough to increase the temperature of the combustion chamber 3 sufficiently (S204), and (4) whether the water temperature Tstop (i−1) at the beginning of engine stop of the most recent engine operation is less than a predetermined value "a" (S205).

Then, when the determinations in both Steps S204 and S205 are YES, the temperature of the combustion chamber 3 is estimated to be low at the beginning of engine stop of the most recent engine operation. Here, generally if the water temperature Tstop (i−1) at the beginning of engine stop of the most recent engine operation is low, the temperature of the combustion chamber 3 at that time is estimated to also be low. It is conceivable, however, that there may be cases in which the temperature of the combustion chamber 3 rises due to heat generated by the engine 1 even if the water temperature Tstop (i−1) at the beginning of engine stop is less than the predetermined value "a", such as when the engine 1 is started when the cooling water temperature of the engine 1 is extremely low. Therefore the temperature of the combustion chamber 3 is estimated based on the water temperature Tstop (i−1) at the beginning of engine stop, which serves as a parameter for the temperature of the combustion chamber 3 at the beginning of engine stop of the most recent engine operation, as well as the amount of water temperature rise Tup from the most recent engine operation at the time of that estimation.

In other words, the less of a difference there is between the engine cooling water temperature at the beginning of engine stop and the engine cooling water temperature at the beginning of engine startup, the less heat there is generated by the internal combustion engine, and the less the temperature of the combustion chamber will rise from engine operation. Therefore, by estimating the temperature of the combustion chamber at the beginning of engine stop based on the difference between the engine cooling water temperatures (or amount of water temperature rise Tup), that estimation is able to be even more accurate.

Generally, the shorter the amount of time that passes from when the engine is started up until the engine is stopped, i.e., the shorter the operation time of the internal combustion engine, the less heat that is generated by the internal combustion engine, and the less the temperature of the combustion chamber rises from engine operation. Therefore, by estimating the temperature of the combustion chamber at the beginning of engine stop based on the amount of time that has passed, that estimation is able to be even more accurate.

The processes of [2] are processes (S206 and S207) for determining whether the time from the most recent engine operation until the current engine start (engine stop time) is short.

In these processes, first an amount of water temperature drop Tdown while the engine is stopped, from the most recent engine operation until the current engine operation, is calculated by subtracting the water temperature Tstop (i−1) at the beginning of engine stop of the most recent engine operation from the water temperature Tstart (1) at the beginning of engine startup of the current engine operation (S206). Then it is determined whether the temperature of the amount of water temperature drop Tdown is less than a predetermined value "b" (S207). When the determination in Step S207 is YES, the stop time of the engine 1 is determined not to be long enough for the cooling water temperature to drop sufficiently while the engine 1 is stopped, and therefore the stop time of the engine 1 is determined to be short.

Figure 4:
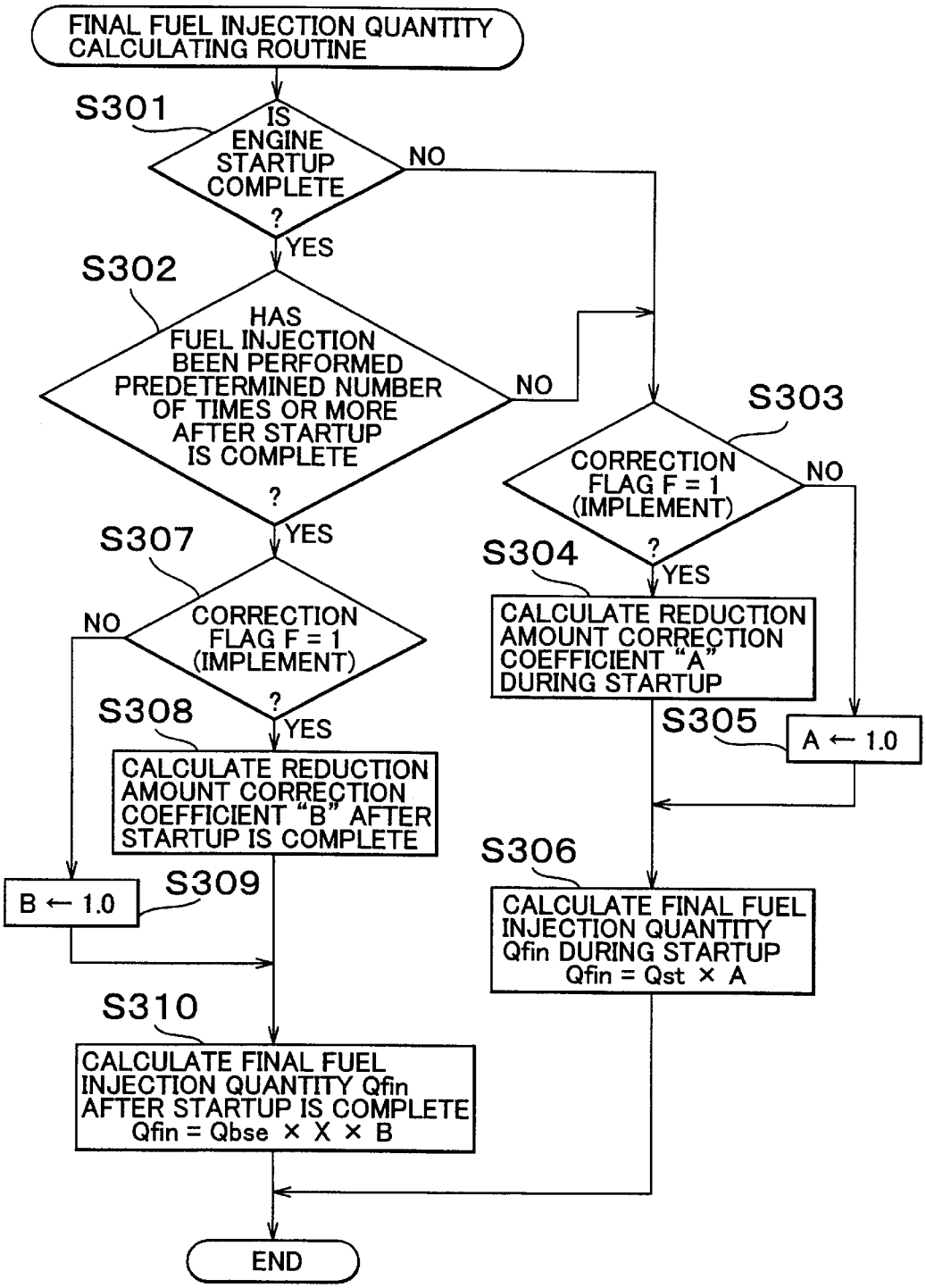
FIG. 4 is a flowchart showing a calculation routine for a final fuel injection quantity Qfin.

Next, a calculation routine for a final fuel injection quantity Qfin, which is used for fuel injection quantity control of the engine 1, will be described with reference to the flowchart in FIG. 4, which shows a final fuel injection quantity calculating routine. This final fuel injection quantity calculating routine is executed by the electronic control unit 10 at predetermined intervals of time, for example.

In the final fuel injection quantity calculating routine, it is first determined whether the engine 1 has completed starting up (S301). This is determined based on whether an engine rotation speed obtained based on a detection signal from the crankshaft position sensor 16, for example, has reached a predetermined idle rotation speed. If the determination in Step S301 is YES, it is then determined whether the fuel injection after the engine 1 has completed starting up was performed a predetermined number of times or more (S302).

When there is a determination of NO in either Step S301 or Step S302, processes (S303 through S306) are performed for determining the final fuel injection quantity Qfin during engine startup. When the final fuel injection quantity Qfin during engine startup is calculated by these processes, the fuel injection valve 4 is then driven by the electronic control unit 10 so that fuel of a quantity corresponding to that value is injected into the combustion chamber 3.

The final fuel injection quantity Qfin during engine startup is calculated based on an injection quantity injection quantity during startup Qst which is set based on the cooling warning temperature T, and a reduction amount correction coefficient A used for reducing the fuel injection quantity during engine startup. The reduction amount correction coefficient A is initially set to a value smaller than "1.0" as an initial value, for example, when the correction flag F is "1 (implement)" (S303: YES). Thereafter, the reduction amount correction coefficient A is calculated so as to gradually increase toward "1.0" as time passes (S304).

Figures 5A, 5B:
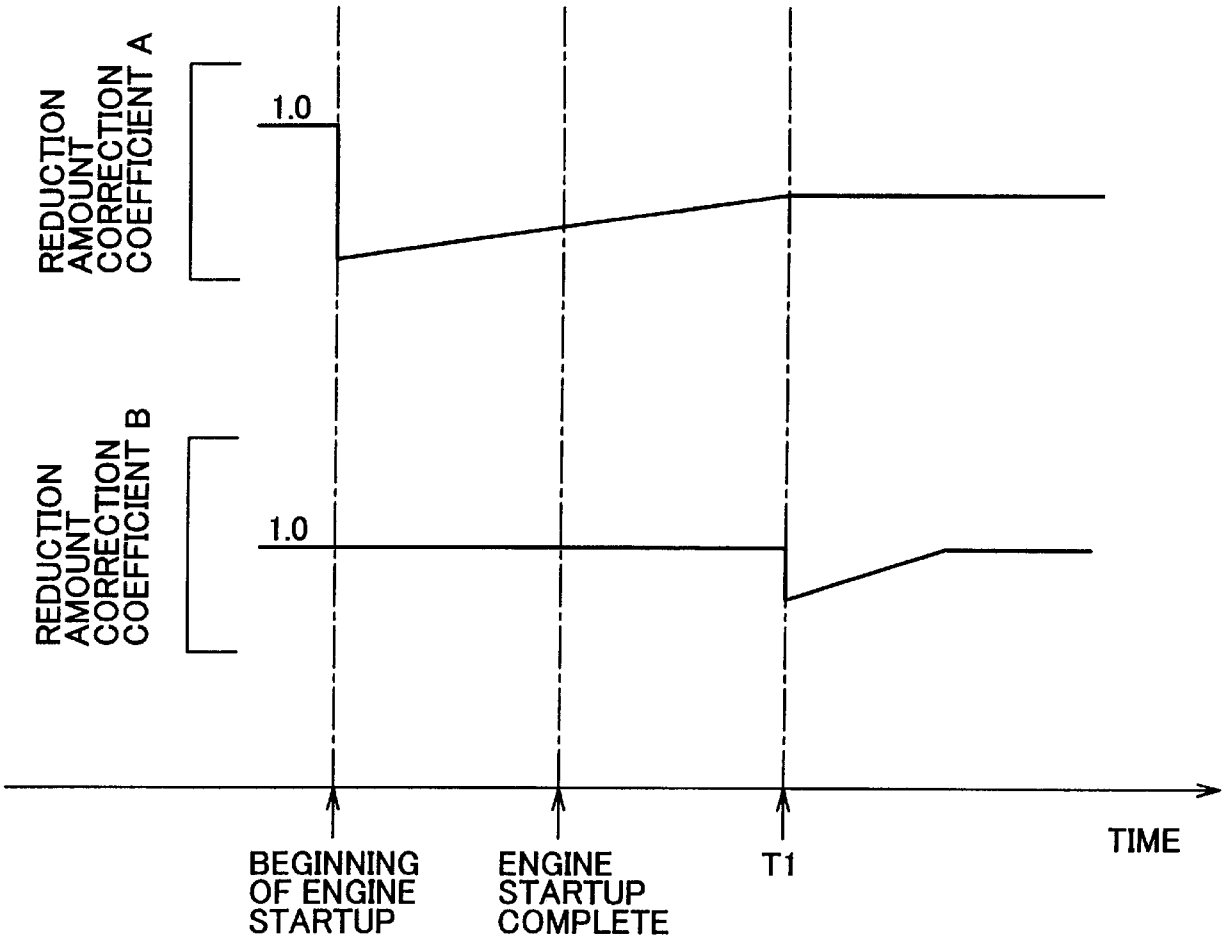
FIG. 5A and FIG. 5B are time charts showing the shift over time of reduction amount correction coefficients A and B when the correction flag F is "1 (implement)" at engine startup.

Therefore, this reduction amount correction coefficient A shifts after the beginning of engine startup as shown in FIG. 5A when the correction flag F is "1 (implement)" at the beginning of startup of the engine 1. Also, the initial value of the reduction amount correction coefficient A is set based on the water temperature Tstop (i−1) at the beginning of engine stop, which serves as a parameter for the temperature of the combustion chamber 3 at the beginning of engine stop of the most recent engine operation, and amount of water temperature drop Tdown during engine stop, which serves as a parameter for the stop time of the engine 1. Here, the relationship between the initial value of the reduction amount correction coefficient A during startup, the water temperature Tstop (i−1) at the beginning of engine stop, and the amount of water temperature drop Tdown is shown in FIG. 6.

Figure 6:
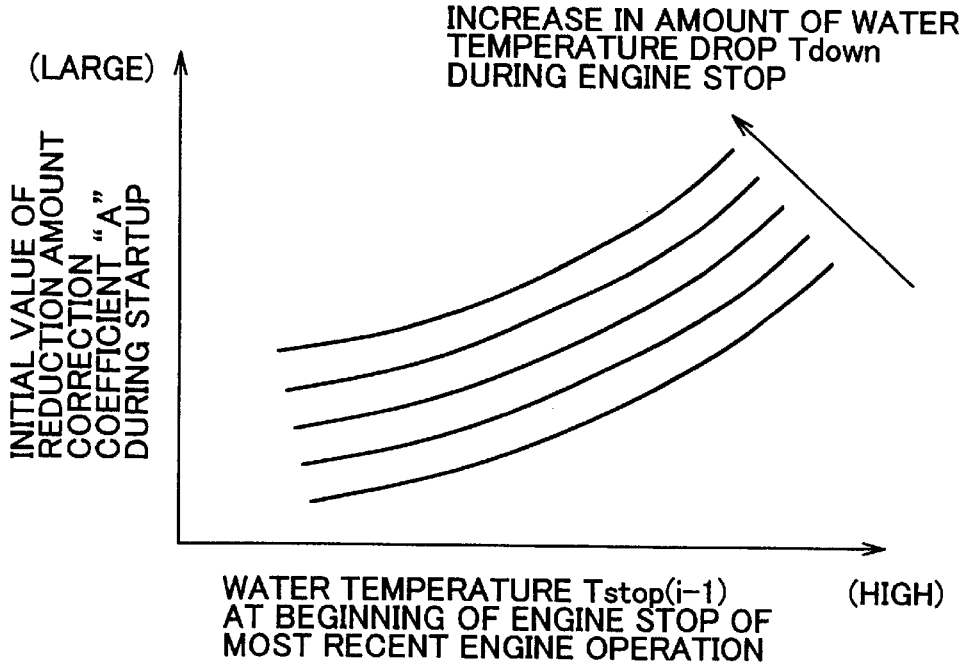
FIG. 6 is an explanatory view for illustrating the relationship between the initial value of the reduction amount correction coefficient A and the water temperature Tstop (i−1) at the beginning of engine stop and the amount of water temperature drop Tdown.

As shown in FIG. 6, when the amount of water temperature drop Tdown is temporarily constant, the initial value of the reduction amount correction coefficient A decreases to the side farther away from "1.0" as the water temperature Tstop (i−1) at the beginning of engine stop drops. This is because as the water temperature Tstop (i−1) at the beginning of engine stop and the temperature of the combustion chamber 3 at the beginning of engine stop drop, it is highly likely that a lot of fuel is adhered to the inside wall surface of the combustion chamber 3 at engine startup, so it is preferable to increase the reduction amount of the fuel injection quantity during engine startup.

Moreover, when the water temperature Tstop (i−1) at the beginning of engine stop is temporarily constant, the initial value of the reduction amount correction coefficient A decreases to the side farther away from "1.0" as the amount of water temperature drop Tdown during engine stop decreases. This is because less fuel that is adhered to the inside wall surface of the combustion chamber 3 vaporizes as time passes the lower the amount of water temperature drop Tdown and the shorter the engine stop time, so it becomes more likely that a lot of fuel is adhered to the inside wall surface of the combustion chamber 3 at engine startup. It is therefore preferable to increase the reduction amount of the fuel injection quantity during engine startup.

After the reduction amount correction coefficient A is calculated in Step S304 (FIG. 4), the final fuel injection quantity Qfin is then calculated by multiplying the reduction amount correction coefficient A by the injection quantity during startup Qst (S306). Then by performing fuel injection quantity control based on the final fuel injection quantity Qfin, the fuel injection quantity is reduced such that the air-fuel ratio does not become excessively rich following vaporization of the fuel that was adhered to the inside wall surface of the combustion chamber 3 during engine startup. The reduction amount is increased the lower the temperature of the combustion chamber 3 at the beginning of engine stop of the most recent engine operation. The reduction amount is also increased the shorter the time from the beginning of the most recent engine stop until the beginning of the current engine start.

When the correction flag F is "0 (stop)" and not "1 (implement)" when the reduction amount correction coefficient A is calculated (S303: NO), the reduction amount correction coefficient A is set to "1.0" (S305). As a result, the fuel injection amount is not decreased as described above in this case during engine startup.

When the determinations in both Steps S301 and S302 are YES, however, processes (S307 through S310) are performed to calculate the final fuel injection quantity Qfin after the completion of engine startup. When the final fuel injection quantity Qfin after the completion of engine startup is calculated by these processes, the fuel injection valve 4 is then driven by the electronic control unit 10 so that fuel of a quantity corresponding to that value is injected into the combustion chamber 3.

The final fuel injection quantity Qfin after the completion of engine startup is calculated based on a base fuel injection quantity Qbse, which is a theoretical value of the fuel injection quantity appropriate for engine operation at that time, a reduction amount correction coefficient B, which is used for reducing the fuel injection quantity for a predetermined period of time after the completion of engine start, and another correction coefficient X.

The base fuel injection quantity Qbse is calculated based on the engine rotation speed and an engine load ratio. The engine load ratio used here is a value indicative of a current load percentage of the maximum engine load of the engine 1. This engine load ratio is calculated using a parameter corresponding to the intake air quantity of the engine 1 and the engine rotation speed. Some examples of parameters corresponding to the intake air quantity are an intake air pressure obtained based on a detection signal from the vacuum sensor 15, the throttle opening obtained based on a detection signal from the throttle position sensor 14, and the accelerator depression amount obtained based on a detection signal from the accelerator position sensor 12.

Some examples of the other correction coefficient X are a reduction amount correction coefficient for gradually reducing the fuel injection quantity as time passes after engine startup is complete, and a reduction amount correction coefficient for gradually reducing the fuel injection amount following a rise in cooling water temperature after engine startup is complete.

Further, the reduction amount correction coefficient B is initially set to a value smaller than "1.0" as the first initial value, for example, when the correction flag F is "1 (implement)" (S307: YES). Thereafter, the reduction amount correction coefficient B is calculated so as to gradually increase as time passes until it reaches "1.0" (S308).

Therefore, this reduction amount correction coefficient B shifts as shown in FIG. 5B when the correction flag F is "1 (implement)" when (time T1 in FIG. 5) the fuel injection was performed a predetermined number of times or more after startup of the engine 1 is complete. Also, the initial value of the reduction amount correction coefficient B is set based on the water temperature Tstop (i−1) at the beginning of engine stop and amount of water temperature drop Tdown, just as like the reduction amount correction coefficient A. Here, the relationship between the initial value of the reduction amount correction coefficient B after engine startup is complete, the water temperature Tstop (i−1) at the beginning of engine stop, and the amount of water temperature drop Tdown is shown in FIG. 7.

Figure 7:
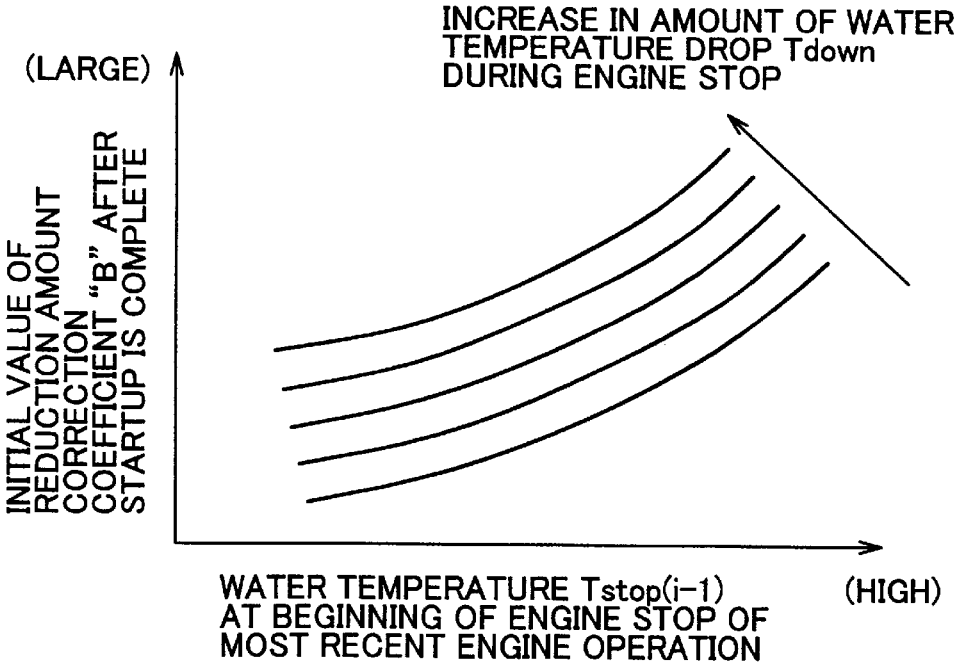
FIG. 7 is an explanatory view for illustrating the relationship between the initial value of the reduction amount correction coefficient B and the water temperature Tstop (i−1) at the beginning of engine stop and the amount of water temperature drop Tdown.

As shown in FIG. 7, the initial value of reduction amount correction coefficient B tends to shift as the water temperature Tstop (i−1) at the beginning of engine stop and the amount of water temperature drop Tdown change, just like the reduction amount correction coefficient A shown in FIG. 6. The reason for this is the same as the reason that the reduction amount correction coefficient A tends to shift as the water temperature Tstop (i−1) at the beginning of engine stop and the amount of water temperature drop Tdown change, as shown in FIG. 6.

After the reduction amount correction coefficient B is calculated in Step S308 (FIG. 4), the final fuel injection quantity Qfin is then calculated by multiplying the reduction amount correction coefficient B by the base fuel injection quantity Qbse and the other correction coefficient X (S310). Then by performing fuel injection quantity control based on the final fuel injection quantity Qfin, the fuel injection quantity is reduced such that the air-fuel ratio does not become excessively rich following vaporization of the fuel that was adhered to the inside wall surface of the combustion chamber 3 for a predetermined period after engine startup is complete. The reduction amount is increased the lower the temperature of the combustion chamber 3 at the beginning of engine stop of the most recent engine operation. The reduction amount is also increased the shorter the time from the beginning of most recent engine stop until the beginning of the current engine start.

When the correction flag F is "0 (stop)" and not "1 (implement)" when the reduction amount correction coefficient B is calculated (S307: NO), the reduction amount correction coefficient B is set to "1.0" (S309). As a result, the fuel injection amount is not decreased, as described above, during the predetermined period after engine startup is complete.

Hereinafter, the advantages obtained by the first exemplary embodiment that is described above in detail will be described.

(5) It is highly likely that fuel is adhered to the inside wall surface at the beginning of engine startup when the temperature of the combustion chamber 3 at the beginning of engine stop of the most recent engine operation is low and the time from the most recent engine operation until the current engine start (engine stop time) is short. Under these conditions, the correction flag F is set to "1 (implement)", and the fuel injection quantity is reduced by the reduction amount correction coefficient A and the reduction amount correction coefficient B during startup of the engine 1 and for a predetermined period of time after startup of the engine 1 is complete. This makes it possible to prevent the air-fuel ratio of the mixture from becoming excessively rich following vaporization of the adhered fuel at engine startup such that poor combustion of the mixture is less likely to occur.

(6) Also, reducing the fuel injection quantity using the reduction amount correction coefficient A and the reduction amount correction coefficient B only under conditions where it is highly likely that the fuel is adhered to the inside wall surface of the combustion chamber 3 at the beginning of engine startup, as described above, minimizes the possibility of the fuel injection quantity being reduced unnecessarily.

(7) The lower the temperature of the combustion chamber 3 at the beginning of engine stop and the shorter the engine stop time, the higher the likelihood that the amount of fuel that is adhered to the inside wall surface of the combustion chamber 3 will increase at the beginning of engine startup. In reducing the fuel injection quantity when taking this into consideration, the reduction amount correction coefficient A and the reduction amount correction coefficient B are made values smaller than "1.0" the lower the temperature of the combustion chamber 3 and the shorter the engine stop time, so as to increase the reduction amount of the fuel injection quantity. As a result, even if the amount of fuel adhered according to the temperature of the combustion chamber 3 differs from that according to the engine stop time, the air-fuel ratio of the mixture is still able to be controlled appropriately by reducing the fuel injection quantity.

(8) Estimation of the temperature of the combustion chamber 3 at the beginning of engine stop of the most recent engine operation, i.e., estimation that that temperature is low, is based on the water temperature Tstop (i−1) at the beginning of engine stop, which is a parameter for the temperature of the combustion chamber 3 at the beginning of engine stop of the most recent engine operation (S205). Moreover, the amount of water temperature rise Tup from the most recent engine operation is also taken into consideration at the time of that estimation (S204). This makes it possible to accurately estimate the temperature of the combustion chamber 3 at the beginning of engine startup of the most recent engine operation.

The foregoing exemplary embodiment can also be modified as described below, for example.

(9) In the foregoing exemplary embodiment, when setting the initial values of the reduction amount correction coefficient A and the reduction amount correction coefficient B, the water temperature Tstop (i−1) at the beginning of engine stop is used which is a parameter for the temperature of the combustion chamber 3 at the beginning of engine stop of the most recent engine operation. The invention, however, is not limited to this. For example, as the parameter, instead of using the water temperature Tstop (i−1) at the beginning of engine stop as it is, a correction according to a parameter for the amount of heat generated by the engine of the most recent engine operation may be added to the water temperature Tstop (i−1) at the beginning of engine stop, and the resultant value after that correction may be used. As the parameter for the amount of heat generated by the engine, the amount of water temperature rise Tup or the operating time of the most recent engine operation, a cumulative fuel injection quantity QS, which is the sum of the fuel injection quantities during that operating time, or a cumulative intake air quantity which is the sum of the intake air quantities of the engine 1 during that operating time may be used, for example. This cumulative intake air quantity is obtained by calculating the intake air quantity of the engine 1 from the intake air pressure obtained based on the detection signal from the vacuum sensor 15 at predetermined cycles, and then adding up all of the intake air quantities.

(10) In the foregoing exemplary embodiment, when setting the initial values of the reduction amount correction coefficient A and the reduction amount correction coefficient B, the amount of water temperature drop Tdown is used which is a parameter for the time (engine stop time) from the beginning of engine stop of the most recent engine operation until the beginning of the current engine start. The invention, however, is not limited to this. For example, as the parameter, instead of amount of water temperature drop Tdown, a pressure (fuel pressure) of the fuel within the delivery pipe 25 may be used. Also the time and date of the beginning of engine stop can be stored in the backup RAM, and the engine stop time obtained based on that time and date, and the time and date of the beginning of engine startup may be used to set the initial value of the reduction amount correction coefficient A and the reduction amount correction coefficient B.

Figure 3B:
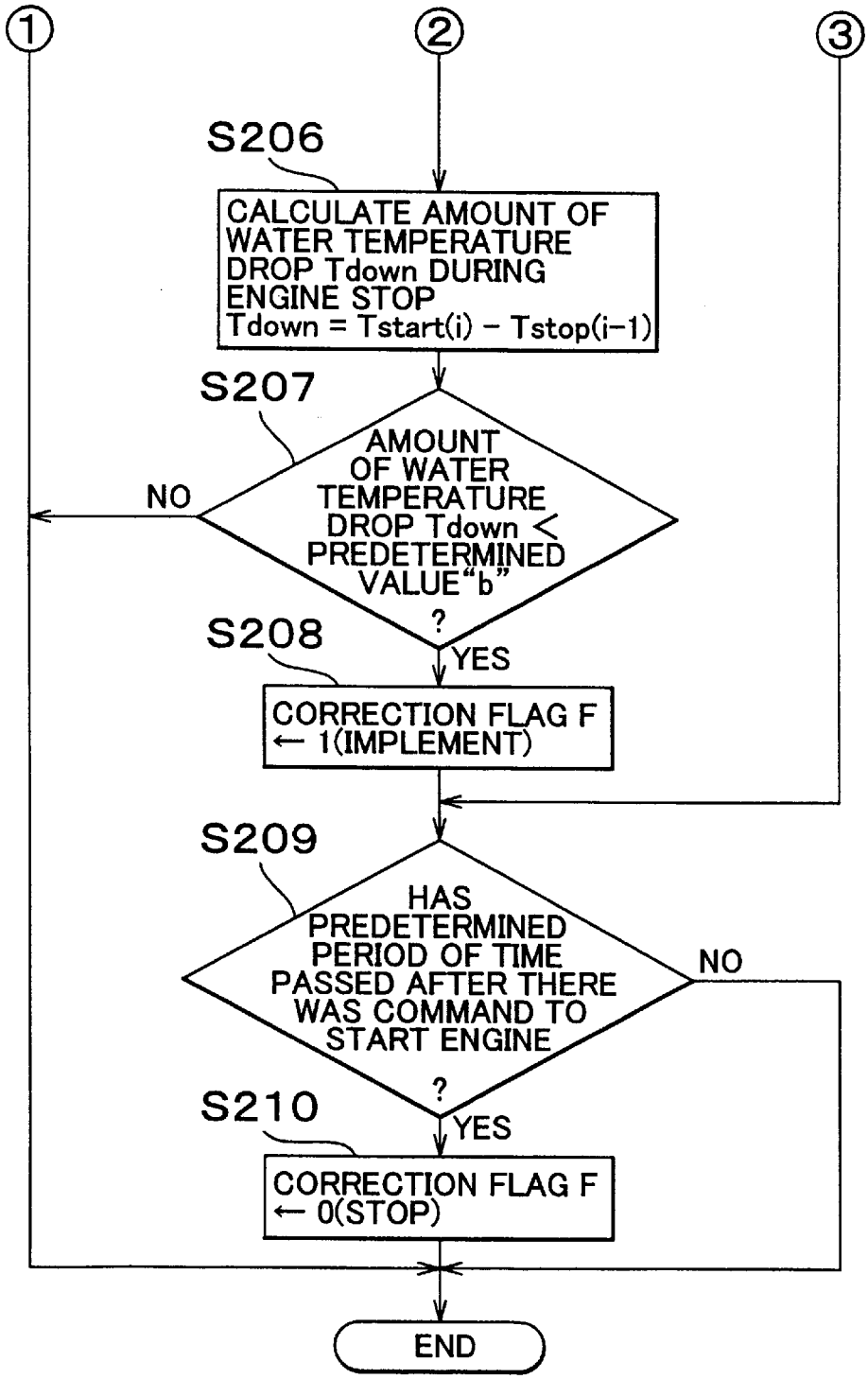

(11) In the foregoing exemplary embodiment, it is determined in the Step S207 in FIG. 3B whether the engine stop time is short based on whether the amount of water temperature drop Tdown is less than the predetermined value "b". The invention, however, is not limited to this. For example, the engine stop time may be obtained based on the time and date of the beginning of engine stop of the most recent engine operation and the time and date of the beginning of engine startup of the current engine operation, and the determination as to whether the engine stop time is short may be made based on that engine stop time.

(12) The temperature of the combustion chamber 3 at the beginning of engine stop may also be estimated based only on the water temperature Tstop (i−1) at the beginning of engine stop of the most recent engine operation without regard to the amount of water temperature rise Tup of the most recent engine operation.

Figure 8:
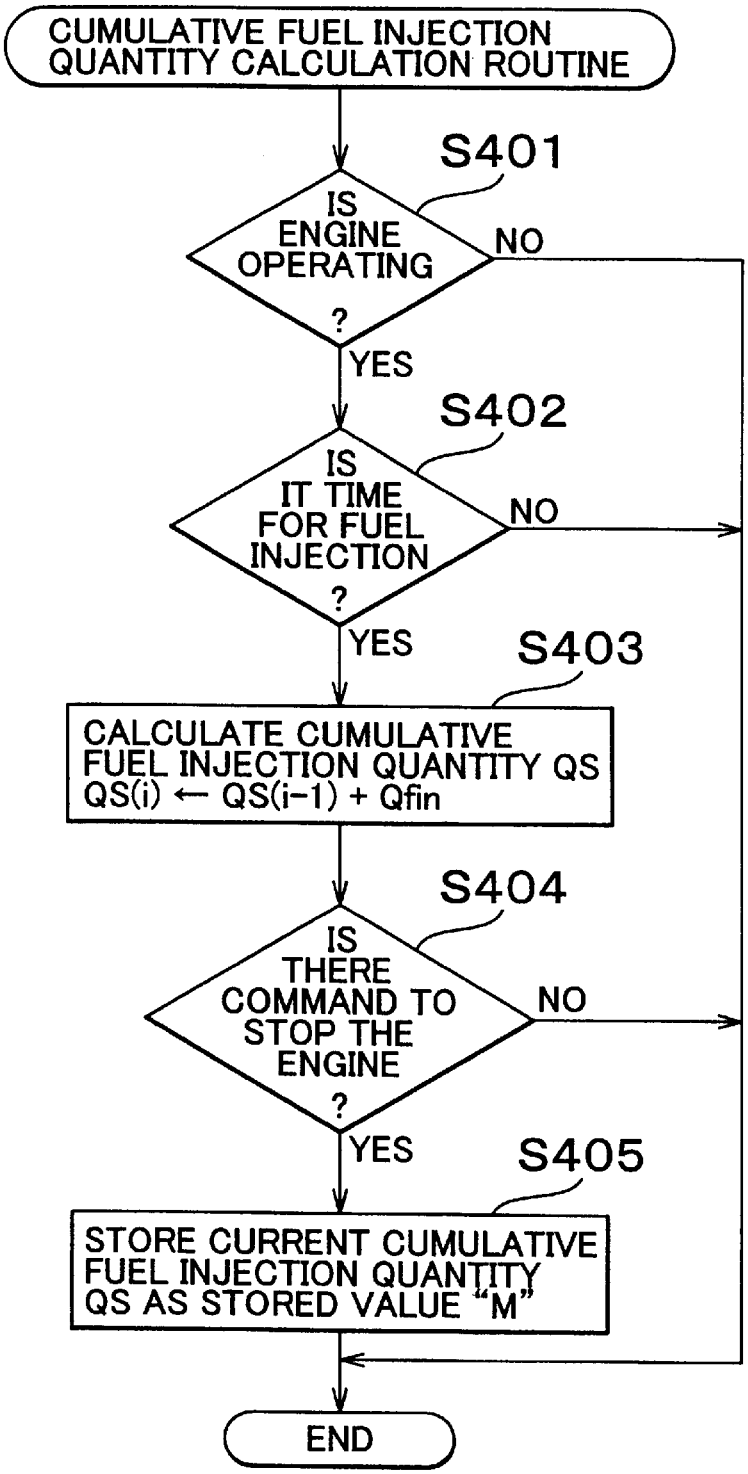
FIG. 8 is a flowchart showing a calculation routine for a cumulative fuel injection quantity QS.
Figure 9A:
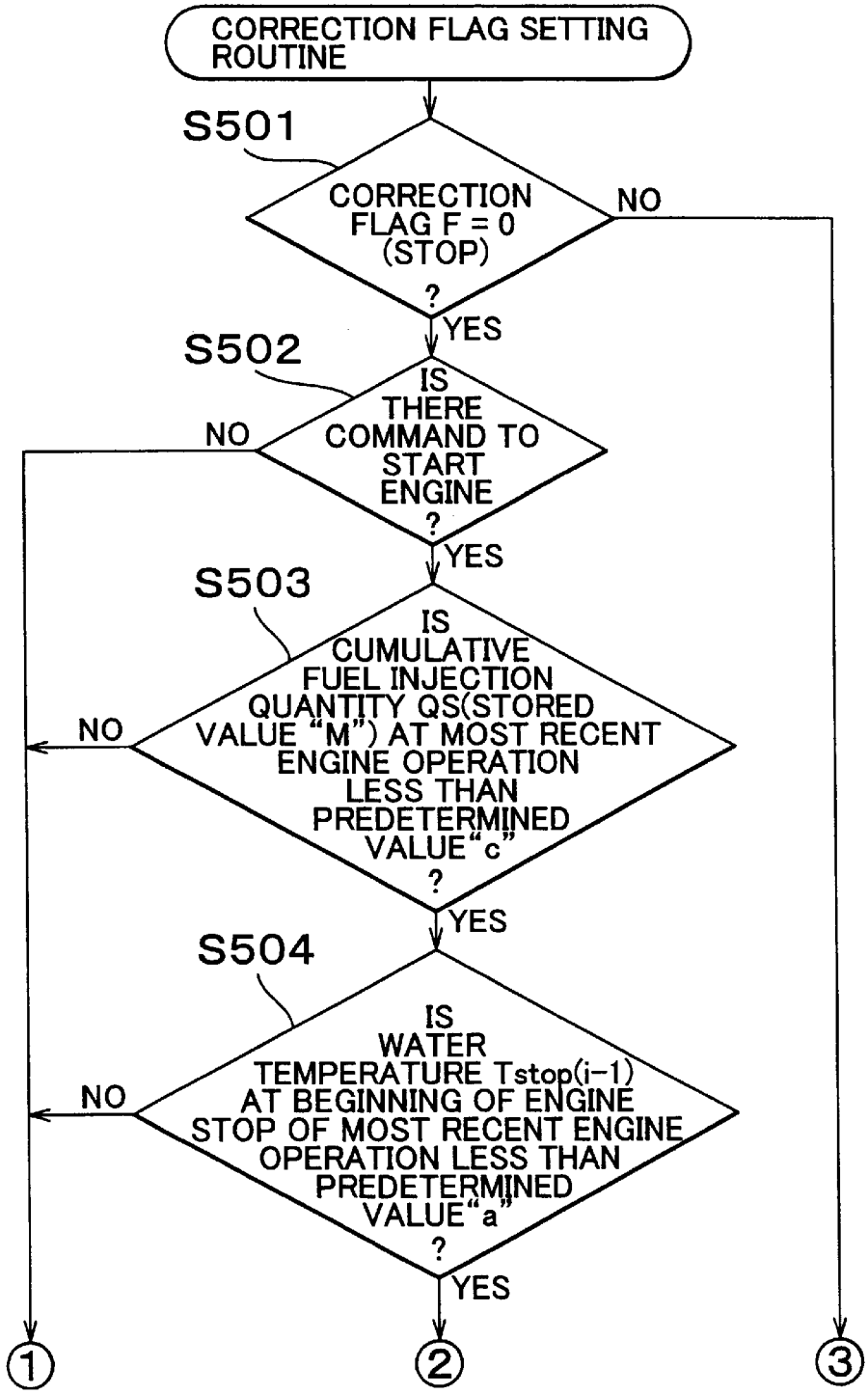
FIG. 9A and FIG. 9B are a flowchart showing a setting routine for the correction flag F according to a second exemplary embodiment.
Figure 9B:
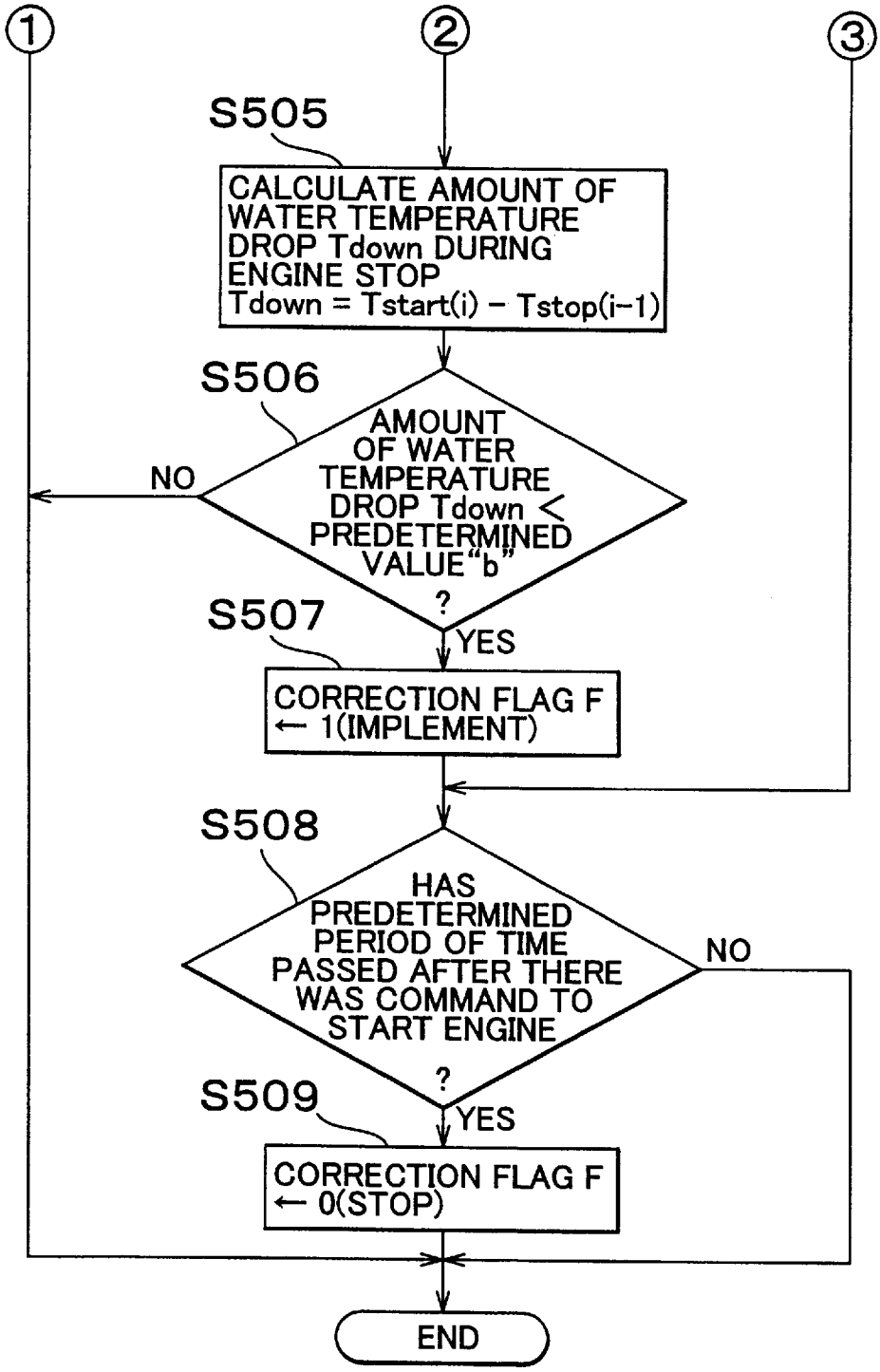

Next, a second exemplary embodiment of the invention will be described with reference to FIG. 8, FIGS. 9A and 9B.

According to this exemplary embodiment, for the determination to estimate the temperature of the combustion chamber 3 at the beginning of engine stop of the most recent engine operation, a determination of whether the cumulative fuel injection quantity QS, which is the sum of the fuel injection quantities of the most recent engine operation, is less than a predetermined value "c" is used instead of the determination (Step S204 in FIG. 3A) of whether the amount of water temperature rise Tup is less than the predetermined value "e" as in the first exemplary embodiment.

A calculation routine for the cumulative fuel injection quantity QS will be described with reference to the flowchart in FIG. 8, which shows a cumulative fuel injection quantity calculating routine. This cumulative fuel injection quantity calculating routine is executed by the electronic control unit 10 at predetermined intervals of time, for example.

In this cumulative fuel injection quantity calculating routine, the cumulative fuel injection quantity QS is calculated when the engine is operating (S401: YES) and it is time for a fuel injection (S402: YES). That is, a current cumulative fuel injection quantity QS (i) is calculated by adding the final fuel injection quantity Qfin to a most recent cumulative fuel injection quantity QS (i−1) (S403). "0", for example, is used as the initial value of the cumulative fuel injection quantity QS calculated in this way.

Next, it is determined whether there was a command to stop the engine 1 (S404). If the determination in Step S404 is YES, then the current cumulative fuel injection quantity QS is stored as a stored value M at a predetermined location in the backup RAM (S405). The stored value M, i.e., the cumulative fuel injection quantity QS when there was a command to stop the engine, increases as the amount of heat generated by the engine 1 increases.

Next, a setting routine of the correction flag F according to this exemplary embodiment will be described with reference to FIG. 9A and FIG. 9B, which is a flowchart showing a correction flag setting routine according to this exemplary embodiment. This correction flag setting routine differs from that in the first exemplary embodiment by only a process (S503) which corresponds to Steps S203 and S204 in the correction flag setting routine (FIG. 3A and FIG. 3B) according to the first exemplary embodiment.

In the correction flag setting routine, when there is a command to start the engine 1 while the correction flag F is "0 (stop)" (S501 and S502 are both YES), [1] processes (S503 and S504) for determining whether the temperature of the combustion chamber 3 at the beginning of engine stop of the most recent engine stop is low, and [2] processes (S505 and S506) for determining whether the time (engine stop time) from the most recent engine operation until the current engine start is short, are performed.

The point (S503) in the processes of [1] that differs from the first exemplary embodiment will now be described in detail.

In the processes of [1] above, it is determined whether the temperature of combustion chamber 3 at the beginning of engine stop of the most recent engine operation is low based on the determinations in Steps S503 and S504. In Step S503, it is determined whether the cumulative fuel injection quantity QS (stored value M) of the most recent engine operation is less than the predetermined value "c". Here, it is determined whether the amount of heat generated by engine 1 during engine operation great enough to make the temperature of the combustion chamber 3 rise sufficiently based on the cumulative fuel injection quantity QS (stored value M).

That is, the smaller the cumulative fuel injection quantity from engine start to engine stop, the less heat there is generated by the internal combustion engine, and the less the temperature of the combustion chamber will rise from engine operation. Therefore, by estimating the temperature of the combustion chamber at the beginning of engine stop based on that cumulative fuel injection quantity, that estimation is able to be even more accurate.

The correction flag F is set to "1 (implement)" when it is determined that the temperature of the combustion chamber 3 at the beginning of engine stop of the most recent engine operation is low and the time from the most recent engine operation until the current engine operation is short in the processes of [1] and [2] above (S507). Also, the correction flag F that was set to "1", as described above, is reset to "0 (stop)" when a predetermined period of time has passed after there was a command to start the engine 1 (S508: YES) (S509).

According to the exemplary embodiment described above, the following effects are able to be obtained in addition to the effects of (1) through (3) described in the first exemplary embodiment.

(13) Estimation of the temperature of the combustion chamber 3 at the beginning of engine stop of the most recent engine operation, i.e., estimation that that temperature is low, is based on the water temperature Tstop (i−1) at the beginning of engine stop, which is a parameter for the temperature of the combustion chamber 3 at the beginning of engine stop of the most recent engine operation (S504). Moreover, the cumulative fuel injection quantity QS of the most recent engine operation is also taken into consideration at the time of that estimation (S503). This makes it possible to accurately estimate the temperature of the combustion chamber 3 at the beginning of engine startup of the most recent engine operation.

The foregoing exemplary embodiment can also be modified as described below, for example.

(14) In the foregoing exemplary embodiment, the cumulative fuel injection quantity QS is used as a parameter for the amount of heat generated by the engine 1. Alternatively, however, the cumulative intake air quantity described above may be used as that parameter.

Next, a third exemplary embodiment of the invention will be described with reference to FIG. 10A and FIG. 10B.

According to this exemplary embodiment, it is determined whether the time (engine stop time) from the beginning of the most recent engine stop until the beginning of the current engine start is short based on whether the pressure (fuel pressure) of the fuel within the delivery pipe 25 at the beginning of engine startup which is obtained by a detection signal from the fuel pressure sensor 26 is equal to, or greater than, a predetermined value "d".

Figure 10A:
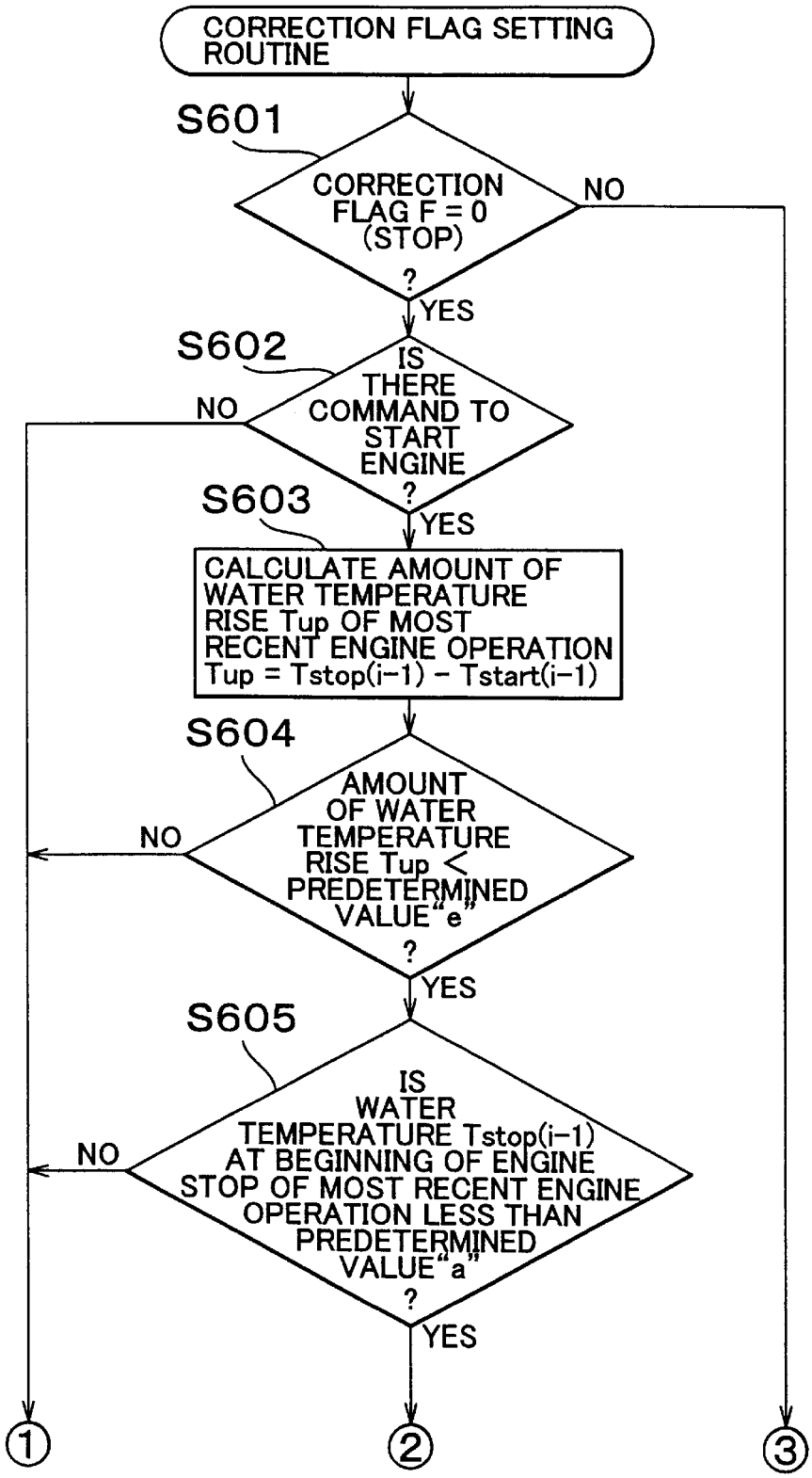
FIG. 10A and FIG. 10B are a flowchart showing a setting routine for the correction flag F according to a third exemplary embodiment.
Figure 10B:
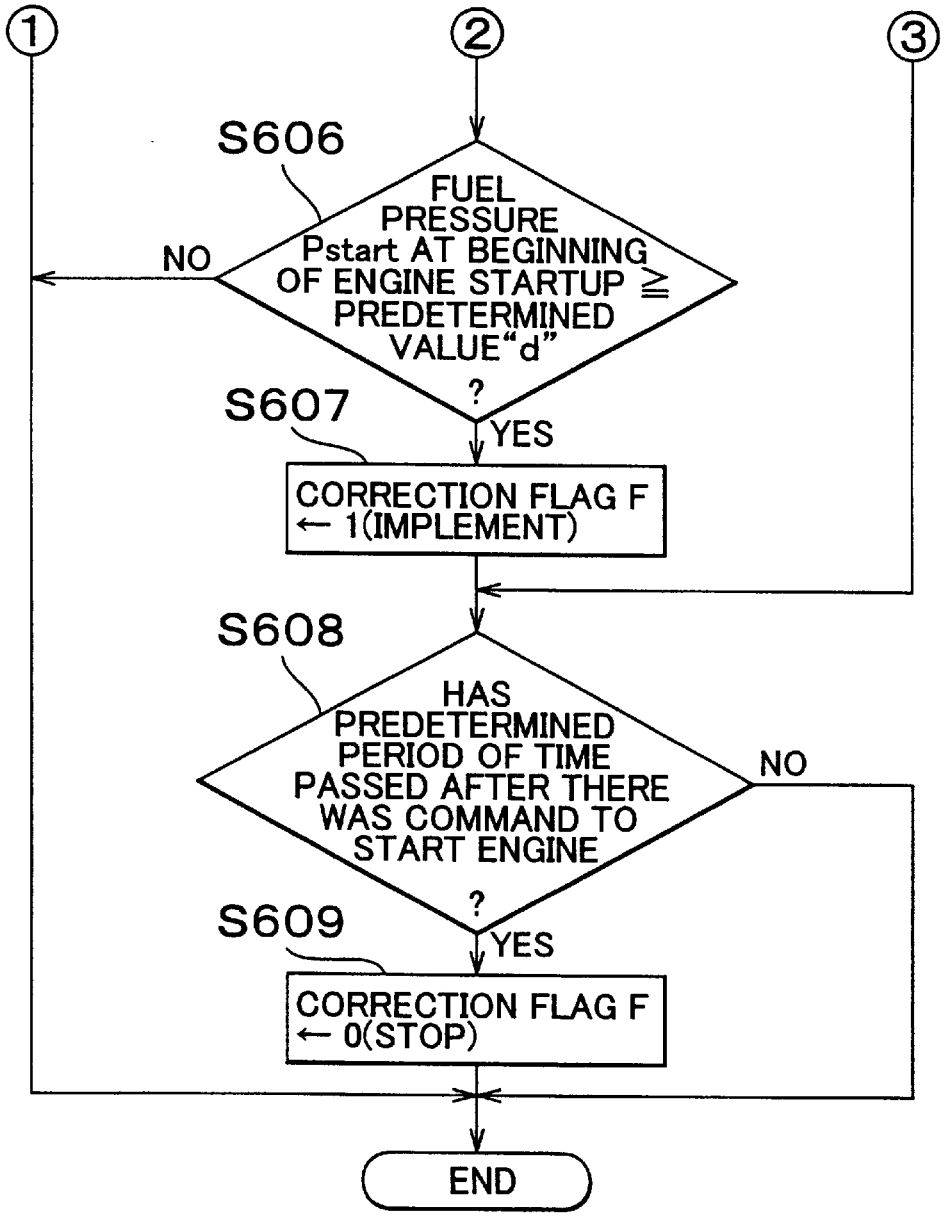

FIG. 10A and FIG. 10B are a flowchart showing a correction flag setting routine according to the third exemplary embodiment of the invention. This correction flag setting routine differs from that in the first exemplary embodiment by only a process (S606) which corresponds to Steps S206 and S207 in the correction flag setting routine (FIG. 3A and FIG. 3B) in the first exemplary embodiment.

In the correction flag setting routine, when there is a command to start the engine 1 while the correction flag F is "0 (stop)" (S601 and S602 are both YES), [1] processes (S603 through S605) for determining whether the temperature of the combustion chamber 3 at the beginning of engine stop of the most recent engine stop is low, and [2] a process (S606) for determining whether the time (engine stop time) from the most recent engine operation until the current engine start is short, are performed.

Now, the process of [2] will be described in detail.

In the process of [2] above, it is determined whether the fuel pressure at the beginning of engine startup is equal to, or greater than, a predetermined value "d". When the determination in Step S606 is YES, the stop time of the engine 1 is determined to be too short for the fuel adhered to the inside wall surface of the combustion chamber 3 to vaporize when the engine 1 is stopped. This determination is able to be made because the fuel pressure has a characteristic that it gradually decreases after the beginning of engine stop.

Then, when it is determined that the temperature of the combustion chamber 3 at the beginning of engine stop of the most recent engine operation is low and the time from the most recent engine operation until the current engine start is short in the processes of [1] and [2] above, the correction flag F is set to "1 (implement)" (S607). Also, the correction flag F that was set to "1" as described above is reset to "0 (stop)" when a predetermined period of time has passed after there was a command to start the engine 1 (S608: YES) (S609).

Similar effects to those of (1) through (4) described in the first exemplary embodiment are also obtained with this third exemplary embodiment.

Next, a fourth exemplary embodiment of the invention will be described with reference to FIGS. 11 through 15.

Instead of minimizing the possibility of the air-fuel ratio becoming rich following vaporization of fuel adhered to the inside wall surface of the combustion chamber 3 by decreasing the fuel injection quantity when the engine is started up, as with the first exemplary embodiment, the fourth exemplary embodiment minimizes the possibility of the air-fuel ratio becoming rich by increasing the intake air quantity.

The intake air quantity is increased by controlling the throttle opening. The throttle opening is controlled based on a throttle opening command value which varies according to the accelerator depression amount or the like. The throttle opening is increased by increasing a ISC correction amount Qcal, which is used in calculating that command value, such that the intake air quantity increases.

Figure 11:
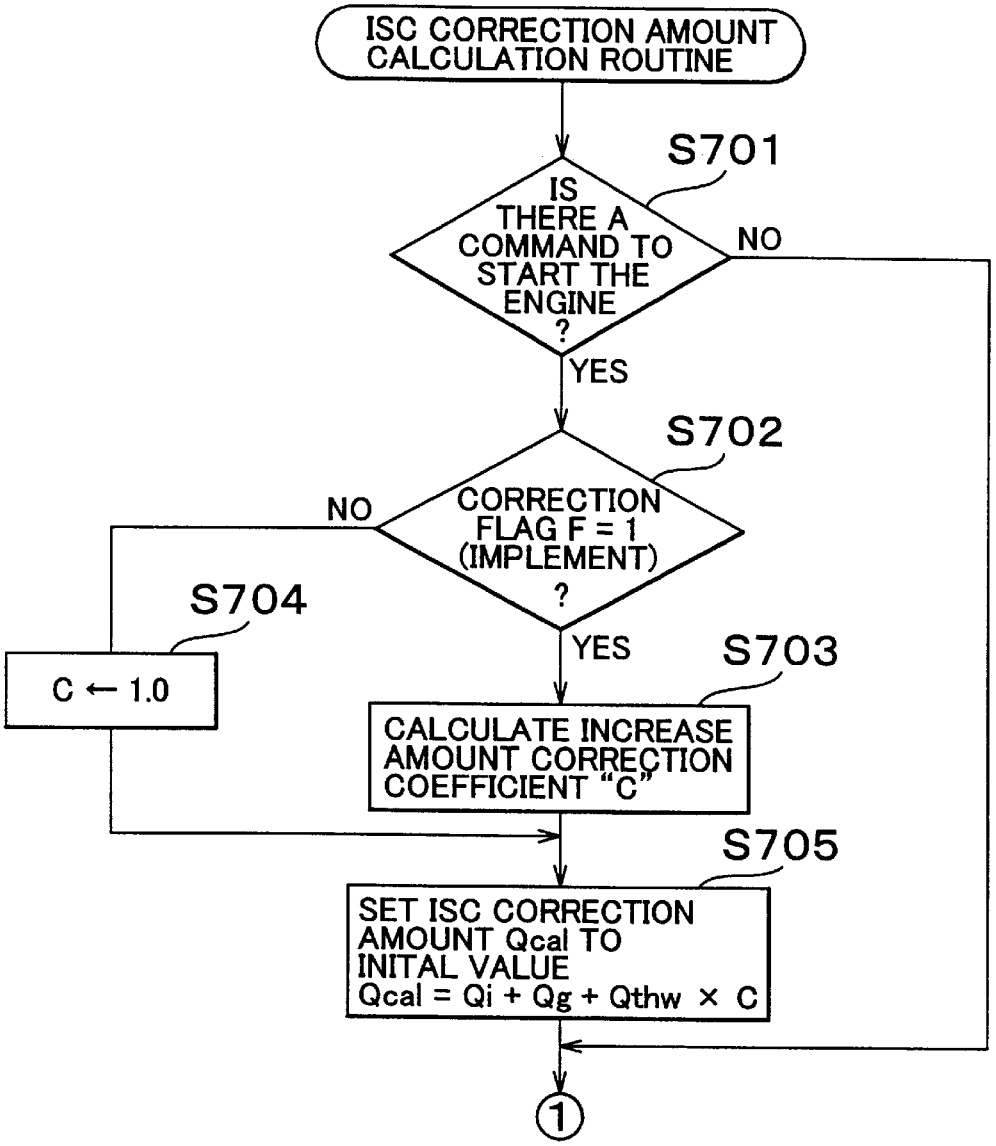
FIG. 11 is a flowchart showing a first part of a calculation routine for an ISC correction amount Qcal.

Here, a calculation routine of the ISC correction amount Qcal will be described with reference to the flowcharts in FIGS. 11 and 12, which show an ISC correction amount calculating routine. This ISC correction amount calculating routine is executed by the electronic control unit 10 at predetermined intervals of time, for example.

In the ISC correction amount Qcal calculating routine, a process for setting the ISC correction amount Qcal to the initial value is performed when there is a command to start the engine 1 (S701: YES in FIG. 11). The initial value of ISC correction amount Qcal is set based on expression (1) below.

$$ISC\ Qcal = Qi + Qg + Qthw \times C \quad (1)$$

ISC Qcal: ISC correction amount

Qi: feedback correction amount

Qg: ISC learned value

Qthw: water temperature correction amount

C: increase amount correction coefficient

In Expression (1), the feedback correction amount Qi is a value which is increased and decreased to adjust the throttle opening (intake air quantity) such that the engine rotation speed becomes a predetermined target value when the engine is idling. Here, the feedback correction amount Qi is set to "0", which is the initial value.

Moreover, the ISC learned value Qg is increased such that the feedback correction amount Qi becomes a value within a predetermined range that includes "0" when the engine is idling. Accordingly, the ISC learned value Qg is learned as a value corresponding to the amount of difference from a proper value of the intake air quantity. This ISC learned value Qg is then stored at a predetermined location in the backup RAM. This stored ISC learned value Qg is used in Expression (1).

Furthermore, the water temperature correction amount Qthw, which increases the lower the cooling warning temperature T, is used to increase the ISC correction amount Qcal. Accordingly, the throttle opening is increased such that the intake air quantity increases the lower the cooling warning temperature T and the larger the water temperature correction amount Qthw (ISC correction amount Qcal).

The increase amount correction coefficient C for increasing the intake air quantity in order to minimize the possibility of the air-fuel ratio becoming rich, is multiplied by this water temperature correction amount Qthw. The increase amount correction coefficient C is calculated as a value larger than "1.0" when the correction flag F is "1 (implement)" (S702: YES) (S703).

Figures 13A, 13B, 13C:
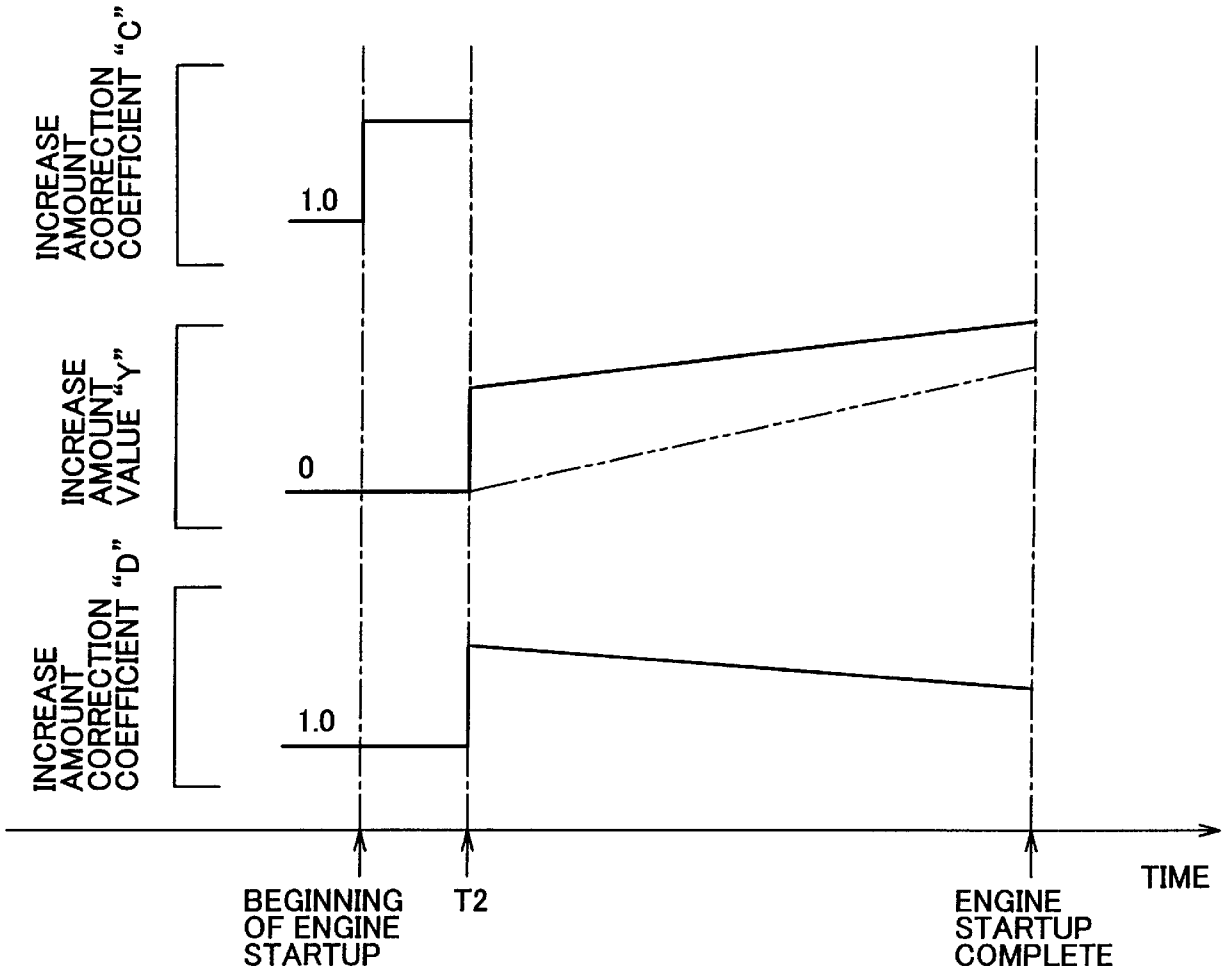
FIG. 13A, FIG. 13B and FIG. 13C are time charts showing the shift in an increase amount correction coefficient C, a correction value Y, and an increase amount correction coefficient D, respectively, over time when the correction F is "1 (implement)" at engine startup.

Therefore, when the correction flag F is "1 (implement)" at the beginning of startup of the engine 1, the increase amount correction coefficient C becomes a value that is larger than "1.0" at that time, as shown in FIG. 13A. Also, the increase amount correction coefficient C is set based on the water temperature Tstop (i−1) at the beginning of engine stop, which serves as a parameter for the temperature of the combustion chamber 3 at the beginning of engine stop of the most recent engine operation, and the amount of water temperature drop Tdown during that engine stop, which serves as a parameter for the stop time of the engine 1. The relationship between the increase amount correction coefficient C, the water temperature Tstop (i−1) at the beginning of engine stop, and the amount of water temperature drop Tdown is shown in FIG. 14.

Figure 14:
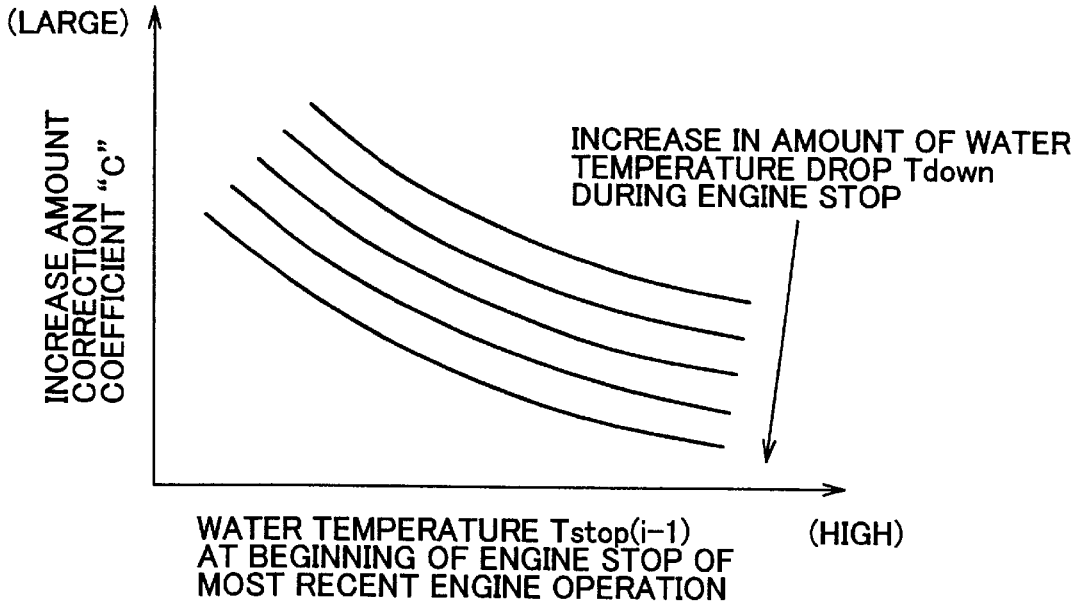
FIG. 14 is an explanatory view for illustrating the relationship between the increase amount correction coefficient C and the water temperature Tstop (i−1) at the beginning of engine stop and the amount of water temperature drop Tdown.

As shown in FIG. 14, when the amount of water temperature drop Tdown is temporarily constant, the increase amount correction coefficient C increases to a side farther away from "1.0" as the water temperature Tstop (i−1) at the beginning of engine stop drops. This is because as the water temperature Tstop (i−1) at the beginning of engine stop and the temperature of the combustion chamber 3 at the beginning of engine stop drop, it becomes more likely that a lot of fuel is adhered to the inside wall surface of the combustion chamber 3 at engine startup, so it is preferable to increase the increase amount of the intake air quantity during engine startup.

Moreover, when the water temperature Tstop (i−1) at the beginning of engine stop is temporarily constant, the increase amount correction coefficient C increases to a side farther away from "1.0" as the amount of water temperature drop Tdown during engine stop decreases. This is because the less fuel that is adhered to the inside wall surface of the combustion chamber 3 that vaporizes as time passes, the lower the amount of water temperature drop Tdown and the shorter the engine stop time, so it becomes more likely that a lot of fuel is adhered to the inside wall surface of the combustion chamber 3 at engine startup. It is therefore preferable to increase the increase amount of the intake air quantity during engine startup.

After the increase amount correction coefficient C is calculated in Step S703 (FIG. 11), the ISC correction amount Qcal is then set to the initial value based on Expression (1). Then by performing throttle opening control based on the command value of the throttle opening calculated using the ISC correction amount Qcal and the like, the intake air quantity is increased such that the air-fuel ratio does not become excessively rich following vaporization of the fuel that was adhered to the inside wall surface of the combustion chamber 3 during engine startup. The increase amount is increased the lower the temperature of the combustion chamber 3 at the beginning of engine stop of the most recent engine operation. The increase amount is also increased the shorter the time from the beginning of most recent engine stop until the beginning of the current engine start.

When the correction flag F is "0 (stop)" and not "1 (implement)" when the increase amount correction coefficient C is calculated (S702: NO), the increase amount correction coefficient C is set to "1.0" (S704). As a result, the intake air quantity is not increased as described above in this case during engine startup.

Figure 12:
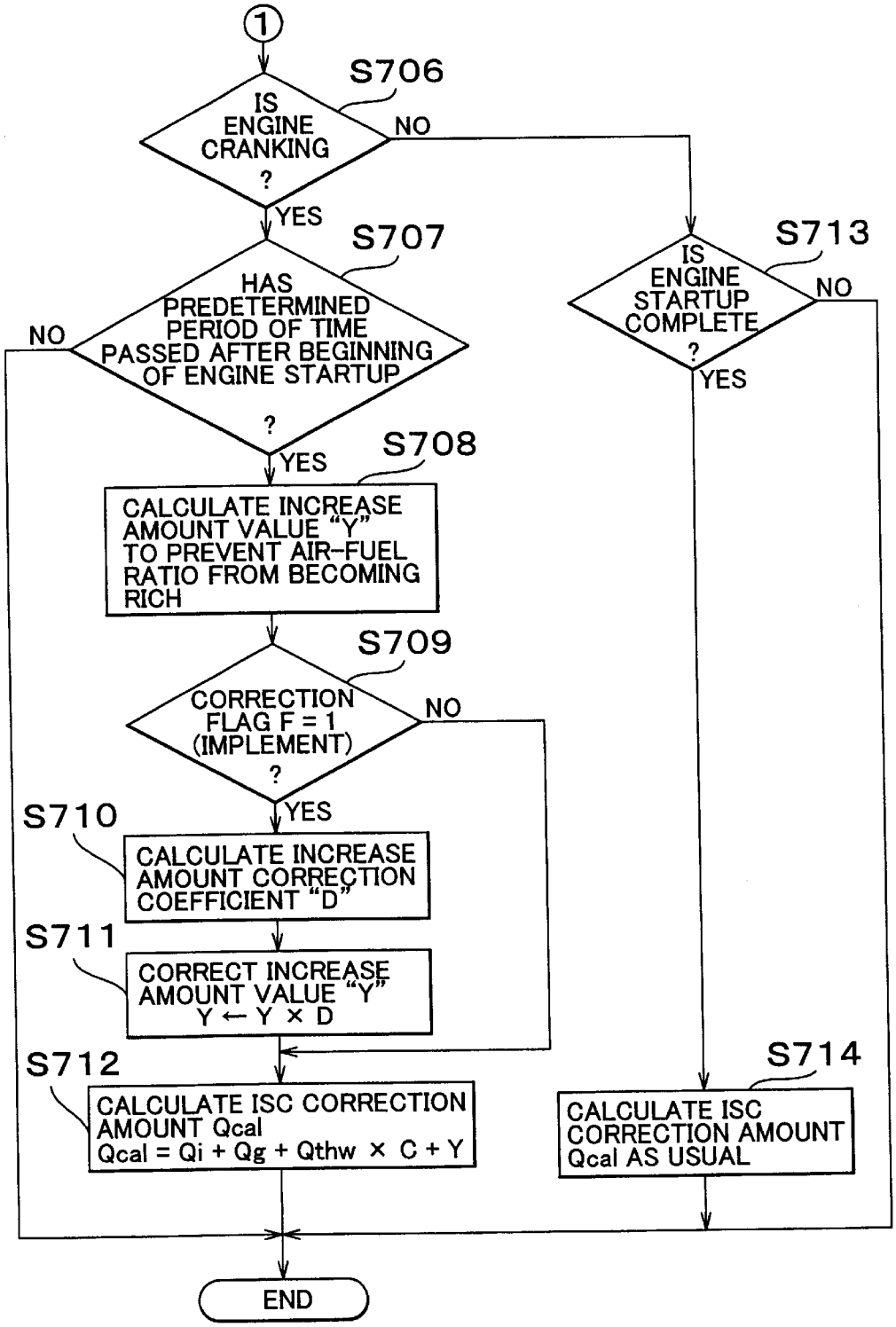
FIG. 12 is a flowchart showing a second part of the calculation routine for an ISC correction shown in FIG. 11.

Next, it is determined whether the engine 1 is in the middle of cranking based, for example, on whether the engine rotation speed is less than the idle rotation speed (S706 in FIG. 12). When the determination in Step S706 is NO, and further, when the engine 1 is determined to have completed starting up (S713: YES), the normal ISC correction amount Qcal is calculated (S714).

Also, when the determination in Step S706 is YES, it is determined whether a predetermined period of time has passed after the beginning of engine startup, i.e., whether the beginning of engine startup took an excessive amount of time (S707). When the determination in Step S707 is YES, it is likely that the engine has not completed starting up due to the fact that the air-fuel ratio is excessively rich. Therefore, processes are performed for increasing the intake air quantity during cranking to prevent the air-fuel ratio from becoming excessively rich (S708 through S712).

The ISC correction amount Qcal, when these processes are performed, is calculated based on Expression (2) below.

$$ISC\ Qcal = Qi + Qg + Qthw \times C + Y \quad (1)$$

Qcal: ISC correction amount

Qi: feedback correction amount

Qg: ISC learned value

Qthw: water temperature correction amount

C: increase amount correction coefficient

Y: increase amount value Y

As is clear from Expression (2), the ISC correction amount Qcal in this case increases from the initial value calculated in Expression (1) by the amount of an increase amount value Y. As a result, the throttle opening during cranking is increased by only the amount of the increase amount value Y. This increases the intake air quantity, which in turn minimizes the possibility of the air-fuel ratio becoming rich, thus decreasing the time it takes for the engine 1 to complete startup.

The increase amount value Y is calculated so as to gradually increase as time passes, as shown by the two-dot chain line in FIG. 13B, for example (S708). Further, the increase amount value Y is increased by a increase amount correction coefficient D when the correction flag F is "1 (implement)" (S709: YES). This increase amount correction coefficient D is initially set to be a value larger than "1.0" as an initial value, for example. Thereafter, the increase amount correction coefficient D is calculated so as to gradually decrease as time passes (S710).

Accordingly, the increase amount correction coefficient D shifts, as shown in FIG. 13C, when the correction flag F is "1 (implement)" when a predetermined period of time has passed from the beginning of engine startup (time T2 in FIG. 13). Also, the initial value of the increase amount correction coefficient D is set based on the water temperature Tstop (i−1) at the beginning of engine stop and the amount of water temperature drop Tdown, just like the increase amount correction coefficient C described above. The relationship between the initial value of the increase amount correction coefficient D, the water temperature Tstop (i−1) at the beginning of engine stop, and the amount of water temperature drop Tdown is shown in FIG. 15.

Figure 15:
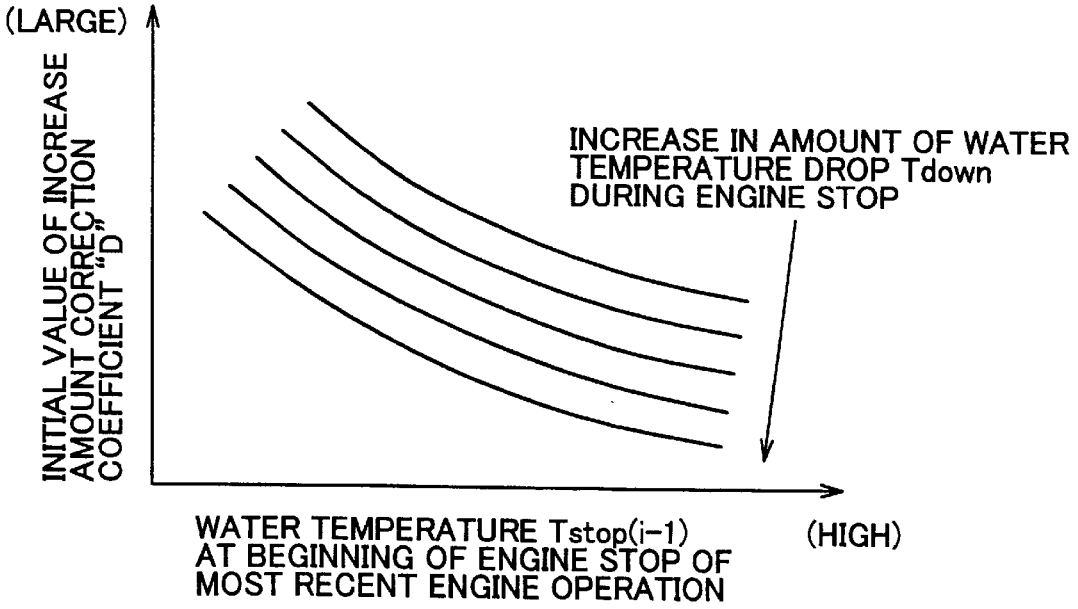
FIG. 15 is an explanatory view for illustrating the relationship between the increase amount correction coefficient D and the water temperature Tstop (i−1) at the beginning of engine stop and the amount of water temperature drop Tdown.

As shown in FIG. 15, the initial value of increase amount correction coefficient D tends to shift as the water temperature Tstop (i−1) at the beginning of engine stop and the amount of water temperature drop Tdown change, just like the increase amount correction coefficient C shown in FIG. 14. The reason for this is the same as the reason that the increase amount correction coefficient C tends to shift as the water temperature Tstop (i−1) at the beginning of engine stop and the amount of water temperature drop Tdown change, as shown in FIG. 14.

After the increase amount correction coefficient D is calculated in Step S710 (FIG. 12), a value which is the product of the increase amount correction coefficient D multiplied by the increase amount value Y is set as a new increase amount value Y, such that the increase amount value Y increases (S711). The thus corrected increase amount value Y then changes as time passes, as shown by the solid line in FIG. 13B.

Then by performing throttle opening control based on the command value of the throttle opening calculated using the ISC correction amount Qcal, the intake air quantity is increased such that the air-fuel ratio does not become excessively rich following vaporization of the fuel that was adhered to the inside wall surface of the combustion chamber 3 during engine startup.

The effects obtained with the fourth exemplary embodiment are described below.

(15) When the temperature of the combustion chamber 3 at the beginning of engine stop of the most recent engine operation is low and the time (engine stop time) from the most recent engine operation until the current engine start is short, it is highly likely that fuel is already adhered to the inside wall surface of the combustion chamber 3 at the beginning of that engine startup. In this situation, the correction flag F is set to "1 (implement)" and the intake air quantity is increased using the increase amount correction coefficient C and the increase amount correction coefficient D when the engine is started up. This makes it possible to prevent the air-fuel ratio of the mixture from becoming excessively rich following vaporization of the adhered fuel when the engine is started up, such that poor combustion of the mixture is less likely to occur.

(16) Also, increasing the intake air quantity using the increase amount correction coefficient C and the increase amount correction coefficient D only under conditions where it is highly likely that fuel is already adhered to the inside wall surface of the combustion chamber 3 at the beginning of engine startup, as described above, minimizes the possibility of the intake air quantity being increased unnecessarily.

(17) The lower the temperature of the combustion chamber 3 at the beginning of engine stop and the shorter the engine stop time, the higher the likelihood that the amount of fuel that is adhered to the inside wall surface of the combustion chamber 3 will increase at the beginning of engine startup. In increasing the intake air quantity when taking this into consideration, the increase amount correction coefficient C and the increase amount correction coefficient D are made values greater than "1.0" the lower the temperature of the combustion chamber 3 and the shorter the engine stop time, so as to increase the increase amount of the intake air quantity. As a result, even if the amount of fuel adhered according to the temperature of the combustion chamber 3 differs from that according to the engine stop time, the air-fuel ratio of the mixture is still able to be controlled appropriately by increasing the intake air quantity.

The fourth exemplary embodiment can also be modified as described below, for example.

(18) In the foregoing exemplary embodiment, when setting the increase amount correction coefficient C and the initial value of the increase amount correction coefficient D, the water temperature Tstop (i−1) at the beginning of engine stop is used which is a parameter for the temperature of the combustion chamber 3 at the beginning of engine stop of the most recent engine operation. The invention, however, is not limited to this. For example, instead of using water temperature Tstop (i−1) at the beginning of engine stop as it is, a correction according to a parameter for the amount of heat generated by the engine of the most recent engine operation may be added to the water temperature Tstop (i−1) at the beginning of engine stop, and the resulting value after that correction may be used. As the parameter for the operating time, the amount of water temperature rise Tup or the operating time of the most recent engine operation, the cumulative fuel injection quantity QS during that operating time, or the cumulative intake air quantity during that operating time may be used, for example.

(19) In the foregoing exemplary embodiment, when setting the increase amount correction coefficient C and the initial value of the increase amount correction coefficient D, the amount of water temperature drop Tdown is used which is a parameter for the time (engine stop time) from the beginning of engine stop of the most recent engine operation until the beginning of the current engine start. The invention, however, is not limited to this. For example, as the parameter, instead of amount of water temperature drop Tdown, a pressure (fuel pressure) at the beginning of engine startup may be used. Also the engine stop time, which is based on the time and date of the beginning of engine stop of the most recent engine operation and the time and date at the beginning of engine startup of the current engine operation, may be used to set the increase amount correction coefficient C and the initial value of the increase amount correction coefficient D.

In the illustrated embodiment, the apparatus is controlled by a controller, which is implemented as a programmed general purpose electronic control unit. It will be appreciated by those skilled in the art that the controller can be implemented using a single special purpose integrated circuit (e.g., ASIC) having a main or central processor section for overall, system-level control, and separate sections dedicated to performing various different specific computations, functions and other processes under control of the central processor section. The controller can be a plurality of separate dedicated or programmable integrated or other electronic circuits or devices (e.g., hardwired electronic or logic circuits such as discrete element circuits, or programmable logic devices such as PLDs, PLAs, PALs or the like). The controller can be implemented using a suitably programmed general purpose computer, e.g., a microprocessor, microcontroller or other processor device (CPU or MPU), either alone or in conjunction with one or more peripheral (e.g., integrated circuit) data and signal processing devices. In general, any device or assembly of devices on which a finite state machine capable of implementing the procedures described herein can be used as the controller. A distributed processing architecture can be used for maximum data/signal processing capability and speed.

While the invention has been described with reference to exemplary embodiments thereof, it is to be understood that the invention is not limited to the exemplary embodiments or constructions. To the contrary, the invention is intended to cover various modifications and equivalent arrangements. In addition, while the various elements of the exemplary embodiments are shown in various combinations and configurations, which are exemplary, other combinations and configurations, including more, less or only a single element, are also within the spirit and scope of the invention.

What is claimed is:

1. A control system for an in-cylinder injection type internal combustion engine in which a fuel is injected directly into a combustion chamber, the control system comprising a controller that:

estimates a temperature of the combustion chamber at a beginning of engine stop of a most recent engine operation when there is a demand to start the engine, and corrects to a lean side an air-fuel ratio of a mixture supplied to the combustion chamber at engine startup based on the estimated temperature of the combustion chamber at the beginning of engine stop of the most recent engine operation.

2. The control system according to claim 1, wherein:

the controller reduces a fuel injection quantity at engine startup based on the estimated temperature of the combustion chamber.

3. The control system according to claim 2, wherein:

the controller reduces a fuel injection quantity at engine startup when the estimated temperature of the combustion chamber is low.

4. The control system according to claim 3, wherein:

the controller increases a reduction amount of the fuel injection quantity as the estimated temperature of the combustion chamber decreases.

5. The control system according to claim 2, wherein:

the controller reduces the fuel injection quantity at engine startup when an amount of time from the most recent engine operation until engine startup is short.

6. The control system according to claim 5, wherein:

the controller increases a reduction amount of the fuel injection quantity as the amount of time from the most recent engine operation until engine startup shortens.

7. The control system according to claim 6, wherein:

the controller estimates the amount of time from the most recent engine operation until engine startup based on a difference between an engine cooling water temperature at the beginning of engine startup of a current engine operation and a water temperature at the beginning of engine stop of the most recent engine operation, and increases the reduction amount of the fuel injection quantity as the amount of time shortens.

8. The control system according to claim 6, wherein:

the controller estimates the time from the most recent engine operation until engine startup based on an injection fuel pressure at the beginning of engine startup of a current engine operation, and increases the reduction amount of the fuel injection quantity as the amount of time shortens.

9. The control system according to claim 1, wherein:

the controller increases an intake air quantity at engine startup based on the estimated temperature of the combustion chamber.

10. The control system according to claim 9, wherein:

the controller increases an intake air quantity at engine startup when the estimated temperature of the combustion chamber is low.

11. The control system according to claim 10, wherein:

the controller increases an increase amount of the intake air quantity as the estimated temperature of the combustion chamber decreases.

12. The control system according to claim 9, wherein:

the controller increases the intake air quantity at engine startup when an amount of time from the most recent engine operation until engine startup is short.

13. The control system according to claim 12, wherein:

the controller increases an increase amount of the intake air quantity as the amount of time from the most recent engine operation until engine startup shortens.

14. The control system according to claim 13, wherein:

the controller estimates the amount of time from the most recent engine operation until engine startup based on a difference between an engine cooling water temperature at the beginning of engine startup of a current engine operation and a water temperature at the beginning of engine stop of the most recent engine operation, and increases the increase amount of the intake air quantity as the amount of time shortens.

15. The control system according to claim 9, wherein:

the controller increases the intake air quantity by increasing a throttle opening.

16. The control system according to claim 1, wherein:

the controller estimates the temperature of the combustion chamber at the beginning of engine stop based on at least an engine cooling water temperature at the beginning of engine stop of the most recent engine operation.

17. The control system according to claim 16, wherein:

the controller estimates the temperature of the combustion chamber at the beginning of engine stop based on a difference between the engine cooling water temperature at the beginning of engine stop of the most recent engine operation and the engine cooling water temperature at the beginning of engine startup of the most recent engine operation.

18. The control system according to claim 17, wherein:

the controller determines that the temperature of the combustion chamber is low at the beginning of engine stop when the engine cooling water temperature at the beginning of engine stop of the most recent engine operation is less than a first predetermined value, and the difference between the engine cooling water temperature at the beginning of engine stop and the engine cooling water temperature at the beginning of engine startup is less than a second predetermined value, and the controller corrects the air-fuel ratio to a lean side upon determination that the temperature of the combustion chamber is low at the beginning of engine stop.

19. The control system according to claim 16, wherein:

the controller estimates the temperature of the combustion chamber at the beginning of engine stop based on an amount of time from engine startup until engine stop of the most recent engine operation.

20. The control system according to claim 16, wherein:

the controller estimates the temperature of the combustion chamber at the beginning of engine stop based on a cumulative intake air quantity from engine startup until engine stop of the most recent engine operation.

21. The control system according to claim 16, wherein:

the controller estimates the temperature of the combustion chamber at the beginning of engine stop based on a cumulative fuel injection quantity from engine startup until engine stop of the most recent engine operation.

22. A control method for an in-cylinder injection type internal combustion engine in which a fuel is injected directly into a combustion chamber, comprising the steps of:

estimating a temperature of the combustion chamber at a beginning of engine stop of a most recent engine operation when there is a demand to start the engine, and correcting to a lean side an air-fuel ratio of a mixture supplied to the combustion chamber at engine startup based on the estimated temperature of the combustion chamber at the beginning of engine stop of the most recent engine operation.

23. The control method according to claim 22, wherein:

the air-fuel ratio is corrected to the lean side by reducing a fuel injection quantity at engine startup based on the estimated temperature of the combustion chamber.

24. The control method according to claim 22, wherein:

the air-fuel ratio is corrected to the lean side by increasing an intake air quantity at engine startup based on the estimated temperature of the combustion chamber.

25. The control method according to claim 22, wherein:

the estimated temperature of the combustion chamber at the beginning of engine stop is estimated based on at least an engine cooling water temperature at the beginning of engine stop of the most recent engine operation.

* * * * *